US009199779B2

(12) United States Patent
Zoss et al.

(10) Patent No.: US 9,199,779 B2
(45) **Date of Patent: *Dec. 1, 2015**

(54) PACKAGES FOR DISPENSING LIQUID AND DRY FOOD

(75) Inventors: Robert A. Zoss, Plymouth, MN (US); Linda Baggio, Hopkins, MN (US); Jeffrey Enz, Minneapolis, MN (US); Michael J. Engstrom, Minneapolis, MN (US); Dan Genord, South Lyon, MI (US)

(73) Assignees: General Mills, Inc., Minneapolis, MN (US); Dairy Management, Inc., Des Plaines, IL (US)

( * ) Notice: Subject to any disclaimer, the term of this patent is extended or adjusted under 35 U.S.C. 154(b) by 1040 days.

This patent is subject to a terminal disclaimer.

(21) Appl. No.: 12/456,015

(22) Filed: Jun. 10, 2009

(65) Prior Publication Data

US 2009/0311389 A1 Dec. 17, 2009

Related U.S. Application Data

(60) Provisional application No. 61/131,508, filed on Jun. 10, 2008.

(51) Int. Cl.

| | |
|---|---|
| ***B65D 81/32*** | (2006.01) |
| ***B65D 55/00*** | (2006.01) |
| ***B65D 51/24*** | (2006.01) |

(Continued)

(52) U.S. Cl.

CPC ..... *B65D 81/3205* (2013.01); *B65D 51/247* (2013.01); *B65D 71/502* (2013.01); *B65D 81/3211* (2013.01); *B65D 81/3222* (2013.01); *B65D 85/80* (2013.01); *B65D 2543/00046* (2013.01)

(58) Field of Classification Search

CPC ..... B65D 81/3205; B65D 81/3211; Y10S 215/08; Y10S 215/902

USPC ..... 426/115, 120, 130; 206/219–222, 514; 220/23.83, 23.86, 23.87, 23.91, 501; 222/129

See application file for complete search history.

(56) References Cited

U.S. PATENT DOCUMENTS

| | | | | |
|---|---|---|---|---|
| 4,558,804 | A | 12/1985 | Keck | |
| 4,779,722 | A * | 10/1988 | Hall | 206/221 |

(Continued)

FOREIGN PATENT DOCUMENTS

| | | |
|---|---|---|
| WO | WO 02/064494 | 8/2002 |
| WO | WO 02/066339 | 8/2002 |
| WO | WO 2007/002623 | 7/2007 |

OTHER PUBLICATIONS

Harriet Carter, "*Cereal-on-the-Go*," http://www.harrietcarter.com/index.cfm/fuseaction/product.detail/categoryID/C64C0157-E9A3-473A-A54B-8320E49D5237/productID/48C530B8-3BC1-4ACF-B37A-F136574422B8, p. 1.

(Continued)

*Primary Examiner* — Drew Becker
*Assistant Examiner* — Luana Z Long
(74) *Attorney, Agent, or Firm* — Diederiks & Whitelaw, PLC; John L. Crimmins

(57) ABSTRACT

Describe are food packages having features such as multiple containers in a single package and multiple pieces for a package; the packages can contain multiple food products including (for example) cereal and milk, for consumption together in a convenient manner.

10 Claims, 25 Drawing Sheets

(51) Int. Cl.
*B65D 71/50* (2006.01)
*B65D 85/80* (2006.01)

(56) References Cited

U.S. PATENT DOCUMENTS

| | | | | |
|---|---|---|---|---|
| 5,328,051 | A | 7/1994 | Potter et al. | |
| 5,514,394 | A * | 5/1996 | Lenahan | 426/120 |
| 5,588,561 | A | 12/1996 | Ness | |
| 5,676,244 | A | 10/1997 | Green et al. | |
| 5,676,275 | A | 10/1997 | Khattar | |
| 5,706,980 | A | 1/1998 | Dickerson | |
| 5,727,679 | A | 3/1998 | Newarski | |
| 5,753,289 | A | 5/1998 | Ness | |
| 6,196,406 | B1 | 3/2001 | Ennis | |
| 6,221,402 | B1 | 4/2001 | Itoh et al. | |
| 6,248,363 | B1 | 6/2001 | Patel et al. | |
| 6,254,907 | B1 | 7/2001 | Galomb | |
| 6,528,105 | B1 | 3/2003 | Gerhart et al. | |
| 6,641,854 | B2 | 11/2003 | Gerhart et al. | |
| 6,913,777 | B2 | 7/2005 | Rebhorn et al. | |
| 7,063,229 | B2 | 6/2006 | Westerhof et al. | |
| 7,815,073 | B1 * | 10/2010 | Fairchild | 222/129 |
| 8,365,960 | B1 * | 2/2013 | Kalaouze | 222/145.5 |
| 2002/0110622 | A1 | 8/2002 | Lloyd et al. | |
| 2005/0172832 | A1 | 8/2005 | Groenke | |
| 2006/0086755 | A1 | 4/2006 | Roth et al. | |
| 2006/0086756 | A1 | 4/2006 | Roth et al. | |
| 2006/0108022 | A1 | 5/2006 | Carter et al. | |
| 2007/0075081 | A1 * | 4/2007 | Stokes | 220/212 |
| 2007/0221513 | A1 | 9/2007 | Taylor-Sharp et al. | |

OTHER PUBLICATIONS

Skopis, *Combination Container Kits*, "Lets get it together", p. 3.

* cited by examiner

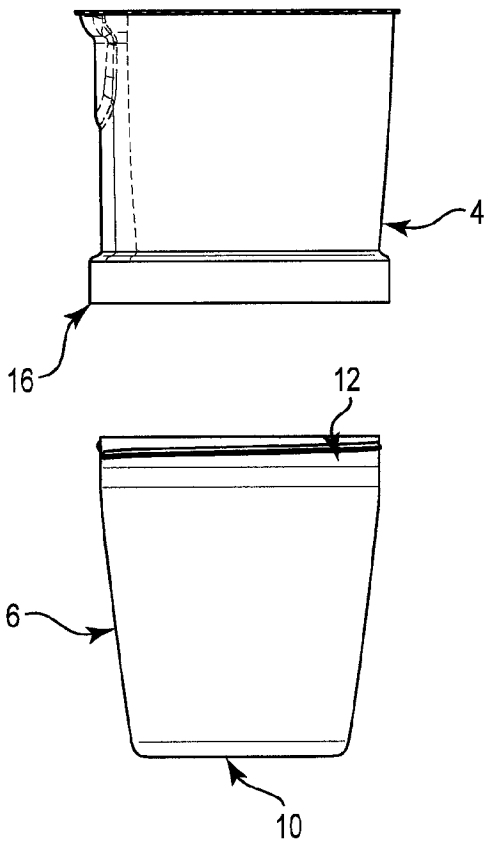
Fig. 1D
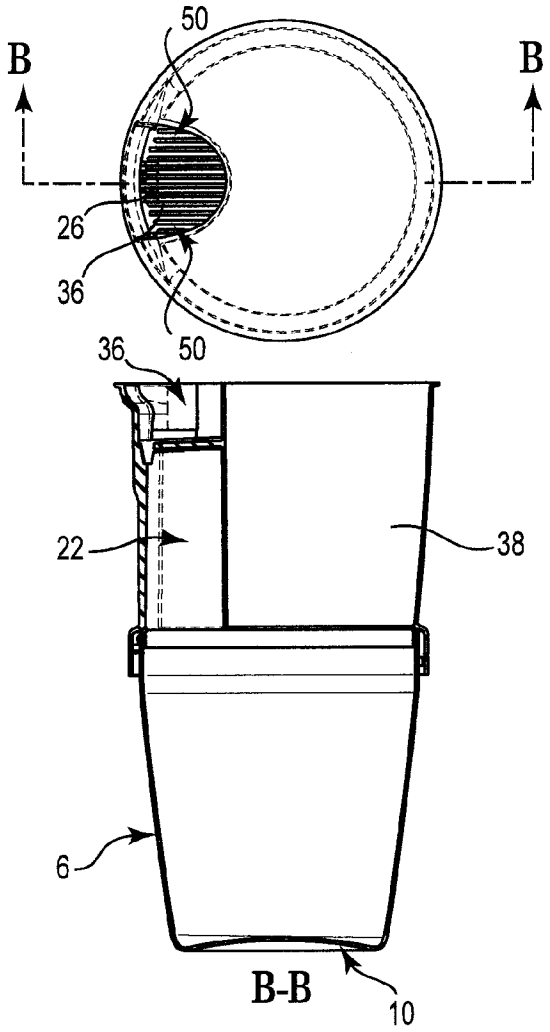

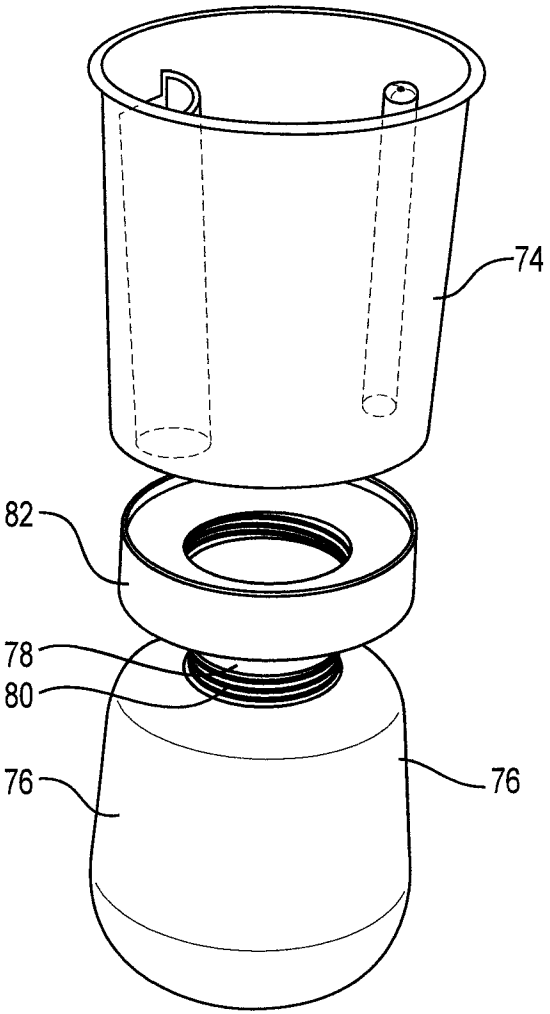
Fig. 2A
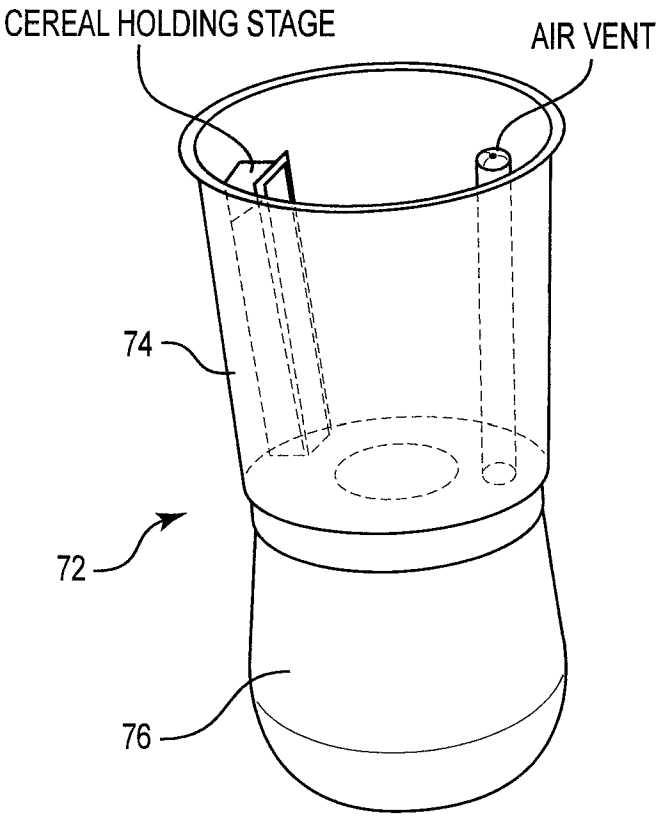

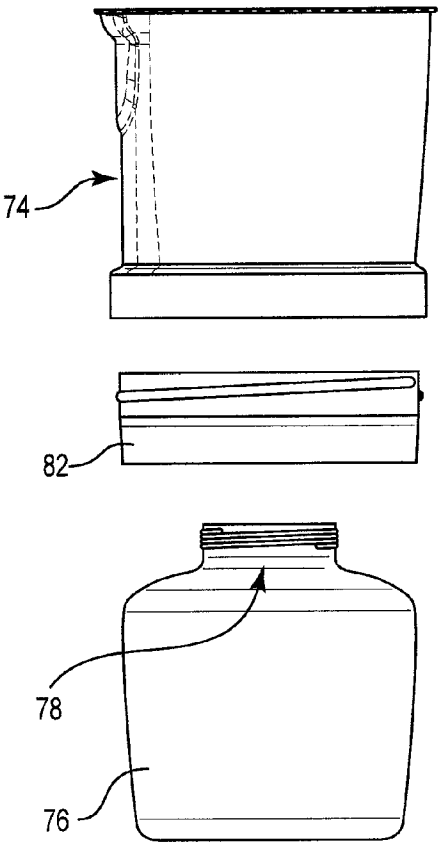
Fig. 2B
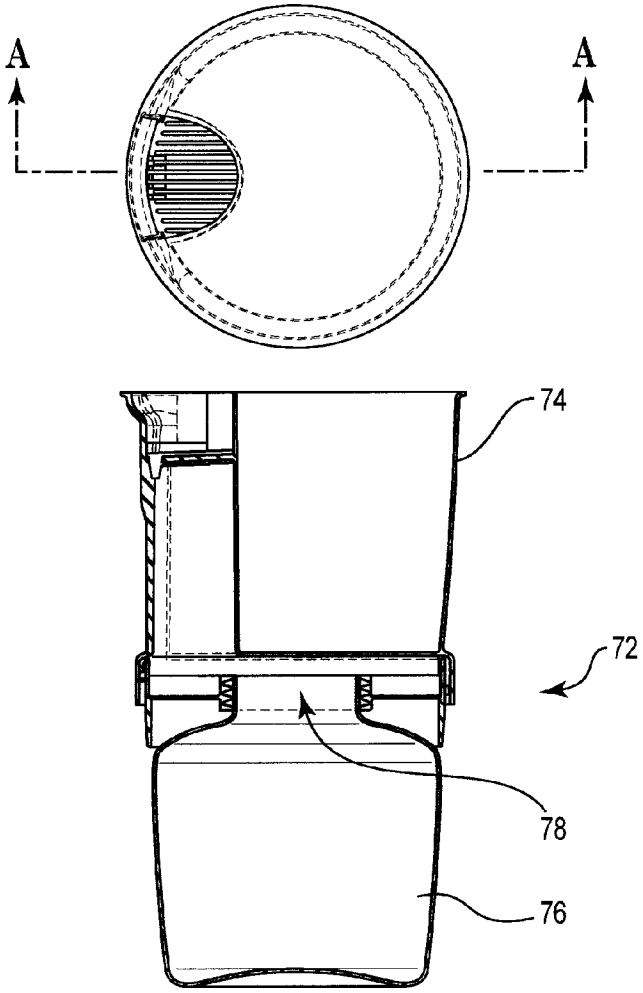

A-A

A-A

A-A

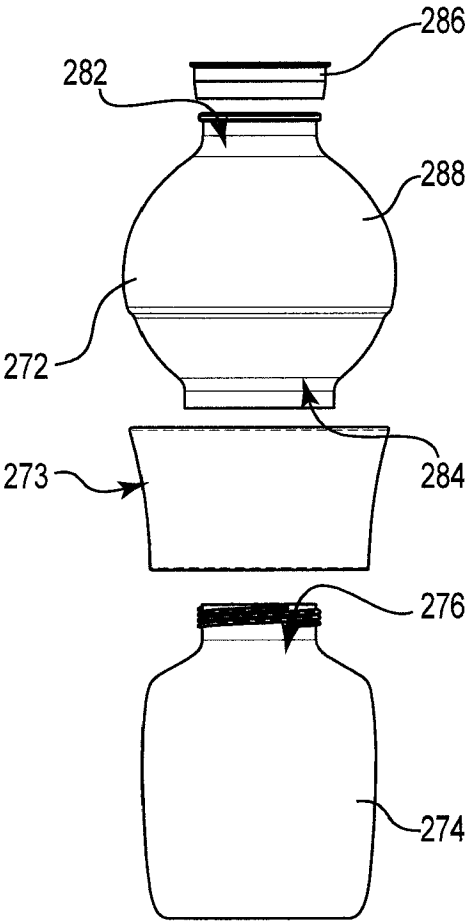
Fig. 7B
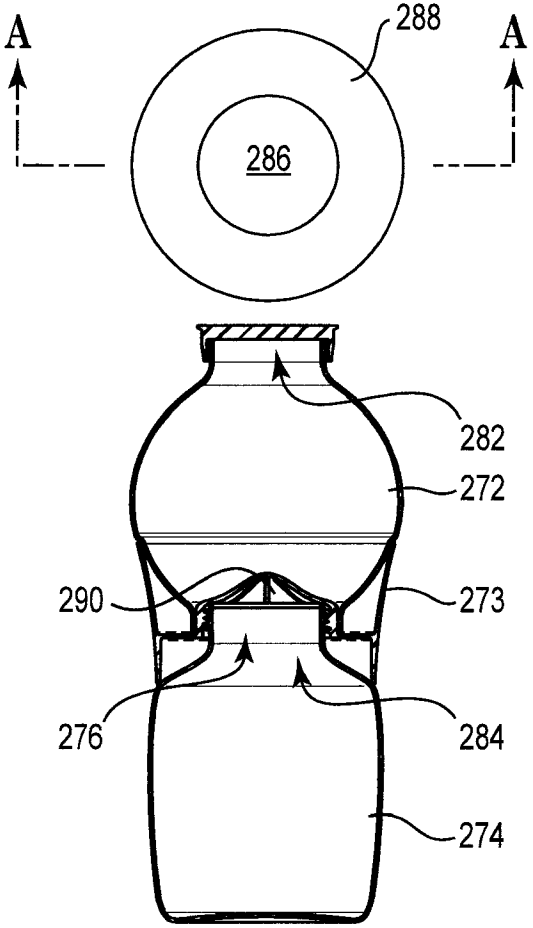
A-A

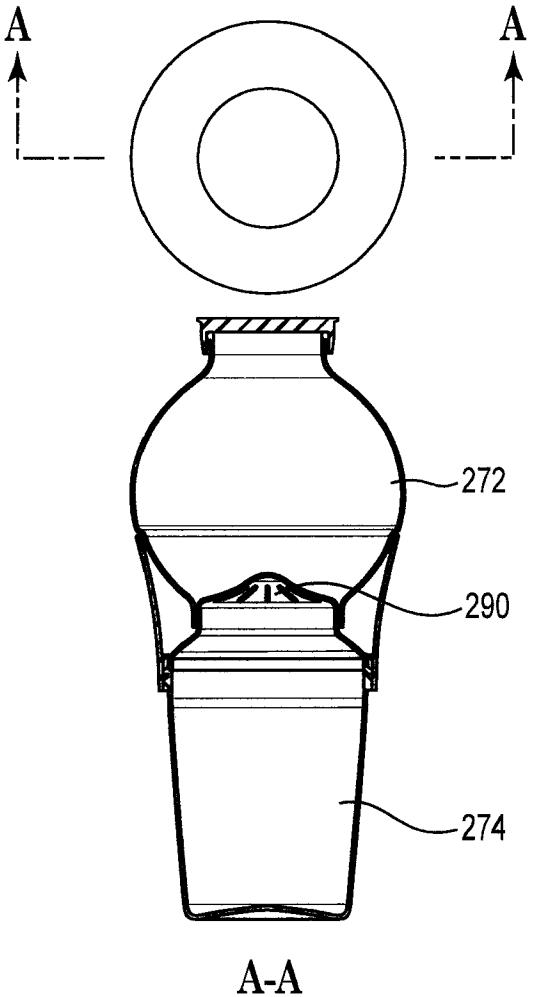
Fig. 7C
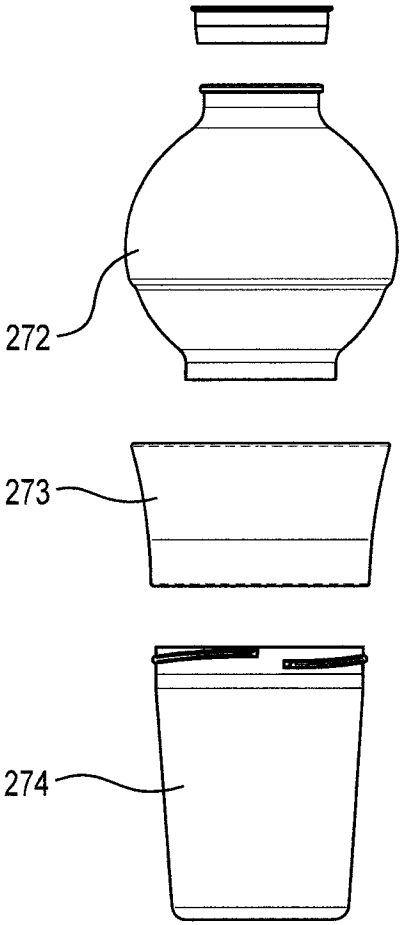

PACKAGES FOR DISPENSING LIQUID AND DRY FOOD

PRIORITY

The present non-provisional patent application claims benefit from U.S. Provisional Patent Application Ser. No. 61/131,508, filed on Jun. 10, 2008, by Engstrom et al., and titled PACKAGES FOR DISPENSING LIQUID AND DRY FOOD, wherein the entirety of said provisional patent application is incorporated herein by reference.

FIELD OF THE INVENTION

The invention relates to food packages having features such as multiple containers in a single package and multiple pieces for a package; the packages can contain multiple food products including cereal and milk, but not necessarily cereal, for consumption together in a convenient manner.

BACKGROUND

Breakfast is considered the most important meal of the day, but traditional "at home" breakfast eating occasions are declining. Mornings are rushed so consumers need on-the-go (e.g., portable) breakfast product solutions. A significant reason for skipping breakfast is not having the time to eat at home. A portable breakfast allows a person to take a serving of breakfast along, away from the home, and eat the breakfast at their morning destination or on the way to that destination.

One of the most common breakfast foods is dry cereal eaten with milk. By conventional methods, a dry cereal is placed in a bowl or other container and milk is poured over the cereal. The consumer consumes the milk and cereal together from the bowl using a spoon. This conventional mode of cereal consumption requires the user to remain stationary to consume the cereal from the bowl and is not an activity that can be safely performed while the consumer is mobile, such as by walking, riding, or driving a vehicle. Also, the serving of cereal is not portable for consumption upon arrival at a destination. Understood limitations of this basic mode of consuming cereal are that the combination of the bowl of cereal and milk is not mobile, and, therefore, the consumer must place the cereal and milk into the bowl in one location (normally a kitchen or eating area), and to also eat the cereal using a spoon in that same location.

To make breakfast a more convenient meal, manufacturers have offered breakfast bars, breakfast sandwiches, and other breakfast foods that can be consumed with a single hand and without preventing the person eating the food from moving from the location at which the food was prepared or purchased. There have also been attempts to construct a container that stores cereal and milk separately and allows the cereal and milk to be removed from a storage location (e.g., kitchen) or place of purchase, to be consumed at a later time or different location. Some of these containers are designed to allow the consumer to eat cereal and milk from a container using a single hand, optionally without having to be at a stationary position, but optionally while moving with the container while consuming the contents. These containers may provide mobility to the cereal eater, but past package designs have suffered from various shortcomings. For instance, past designs may not allow for dispensing a desired amount of milk relative to cereal, may not allow for controlled delivery of cereal, or may allow cereal and milk to contact each other and become soggy.

Various products have been developed to contain cereal and milk separately and then allow the cereal and milk to be mixed when consumed using a container that can be manipulated by one hand. Examples of such product configurations are illustrated and described at U.S. Pat. Nos. 5,588,561, 5,753,289, 6,528,105, and others. Such products show a single container that may hold cereal and milk in separate compartments of a single container, in a manner to allow the cereal and milk to be dispensed from the single container.

Continuing need exists for a cereal container that can contain milk and cereal together in a single package that allows a user to dispense cereal and milk using one hand.

SUMMARY

The following description relates to food packages and containers that can be useful to hold a particulate food (e.g., dry cereal) and a liquid (e.g., milk), separately, and to dispense the particulate food and liquid as a combined mixture. Certain package designs allow for a particulate food and the liquid to be stored, transported, and optionally sold or delivered, together, then consumed by being dispensed from or removed from the package as a mixture.

The packages are particularly useful for storing and allowing consumption of breakfast in the form of dry ("ready-to-eat") breakfast cereal, with milk. Breakfast is considered the most important meal of the day, but traditional "at home" breakfast eating occasions are declining. Mornings are rushed so consumers need on-the-go (e.g., portable) breakfast product solutions. A significant reason for skipping breakfast is not having the time to eat at home. A portable breakfast allows a person to take a serving of breakfast along, away from the home, and eat the breakfast at their morning destination or on the way to that destination.

One of the most common breakfast foods is dry cereal eaten with milk. By conventional methods, a dry cereal is placed in a bowl or other container and milk is poured over the cereal. The consumer consumes the milk and cereal together from the bowl using a spoon. This conventional mode of cereal consumption requires the user to remain stationary to consume the cereal from the bowl and is not an activity that can be safely performed while the consumer is mobile, such as by walking, riding, or driving a vehicle. Also, the serving of cereal is not portable, for consumption upon arrival at a destination. Understood limitations of this basic mode of consuming cereal are that the combination of the bowl of cereal and milk is not mobile, and, therefore, the consumer must place the cereal and milk into the bowl in one location (normally a kitchen or eating area), and to also eat the cereal using a spoon in that same location.

To make breakfast a more convenient meal, manufacturers have offered breakfast bars, breakfast sandwiches, and other breakfast foods that can be consumed with a single hand and without preventing the person eating the food from moving from the location at which the food was prepared or purchased. There have also been attempts to construct a container that stores cereal and milk separately and allows the cereal and milk to be removed from a storage location (e.g., kitchen) or place of purchase, to be consumed at a later time or different location. Some of these containers are designed to allow the consumer to eat cereal and milk from a container using a single hand, optionally without having to be at a stationary position, but optionally while moving with the container while consuming the contents. These containers may provide mobility to the cereal eater, but past package designs have suffered from various shortcomings. For instance, past designs may not allow for dispensing a desired amount of milk relative to cereal, may not allow for controlled delivery of cereal, or may allow cereal and milk to contact each other and become soggy.

The following description includes designs for packages and containers for separately storing milk and cereal. Embodiments of packages allow the user to store or transport milk and cereal together and, at their convenience, and combine the two for consumption. Certain package designs fit into consumers' busy lifestyles by enabling a consumer to eat their favorite cereals and milk while on the go, or to transport a single serving of cereal and milk to a location away from a point of purchase or storage (e.g., kitchen). Embodiments of product designs allow for cereal consumption with little to no preparation, primarily requiring the consumer to grab a combined cereal and milk package, and go; according to different embodiments a consumer may eat upon arriving at their destination, or along the way. Certain embodiments provide better performance relative to past designs for packages that include cereal and milk.

Two general approaches to meet consumer needs are described: 1. A portable package for cereal and milk that allows a user to bring a serving of cereal and milk to a destination, combine the cereal and milk after arriving at their destination, and then eat the mixture with a spoon, and 2. A package that allows a consumer to eat a mixture of cereal and milk with just a single hand, while in motion. Both concepts can either be a complete offering supplying cereal and shelf stable milk, or may in the form of a package that contains cereal and no milk, but permits the user to supply their own serving of milk. In either approach the milk and cereal remain separate until the consumer is ready to consume the cereal and milk together.

In one aspect the invention relates to a multi-container package that includes a lower container. The lower container includes: a lower container interior space defined by a bottom and sidewalls, and an opening in communication with the lower container interior space, at an upper region of the lower container. The multi-container package also includes an upper container connected to the lower container, located above the lower container. The upper container includes an upper container interior space defined by a bottom and sidewalls. The package further includes a passage between the lower container interior space and the upper container, that allows liquid to flow out of the lower container interior space and into the upper container, as the package is tipped, and a vent that allows pressure to equalize in the lower container interior space as liquid flows out of the lower container interior space.

In another aspect the invention relates to a multi-container package that includes a lower container. The lower container includes a lower container interior space defined by a bottom and sidewalls, and an opening in communication with the lower container interior space, at an upper region of the lower container. The package also includes an upper container connected to the lower container and located above the lower container. The upper container includes: an upper container interior space defined by an upper container bottom and upper container sidewalls, the upper container bottom extending between the upper container sidewalls at a lower region of the upper container sidewalls; and a holding stage defined by a shelf and sidewalls, in fluid communication with the lower container interior space through a channel, and in fluid communication with the upper container interior space.

In another aspect the invention relate to package that includes: an interior space defined by a bottom and sidewalls extending between the sidewalls at a lower region of the sidewalls; an aperture located at the bottom or sidewalls; and a holding stage defined by a shelf and sidewalls including a front sidewall, the holding stage in fluid communication with the interior space.

In yet another aspect the invention relates to a package that includes: an interior space defined by a bottom and sidewalls, the bottom extending between the sidewalls at a lower region of the sidewalls, the bottom comprising an aperture; a holding stage defined in part by a shelf and sidewalls, including a front sidewall; and a milk channel located below the holding stage, wherein the holding stage is in fluid communication with the milk channel, and is in fluid communication with the upper container interior space.

In yet another aspect the invention relates to a package that includes: an interior space defined by a bottom, an upper opening, and sidewalls extending between the bottom and the upper opening; an aperture at the bottom comprising a valve, and a liquid-tight engagement element at a lower region of the package.

In another aspect the invention relates to a multi-container package that includes an upper container and a lower container. The upper container includes an opening at a lower region. The lower container includes an opening at an upper region. The upper region of the lower container engages the lower region of the upper container by a liquid-tight engagement such that the opening at the lower region of the upper container aligns with the opening at the upper region of the lower container. The opening of the lower container is separated from the opening of the upper container by a seal.

In another aspect the invention relates to a kit that includes separate milk and cereal containers. The kit includes: a milk container containing milk, a cereal container containing cereal and including a bottom, sidewalls, and a top opening. The cereal container contains cereal, optionally an eating implement, and optionally a napkin. The cereal container is sealed around the top opening by a removable layer.

BRIEF DESCRIPTION OF THE FIGURES

FIG. 1D includes top, side, and side cut-away views of a package as described.

FIG. 2A shows side perspective and exploded side perspective views of a package as described.

FIG. 2B includes top, side, and side cut-away views of a package as described.

FIG. 7B includes top, side, and side cut-away views of a package as described.

FIG. 7C includes top, side, and side cut-away views of a package as described.

DETAILED DESCRIPTION

Figure 1A:
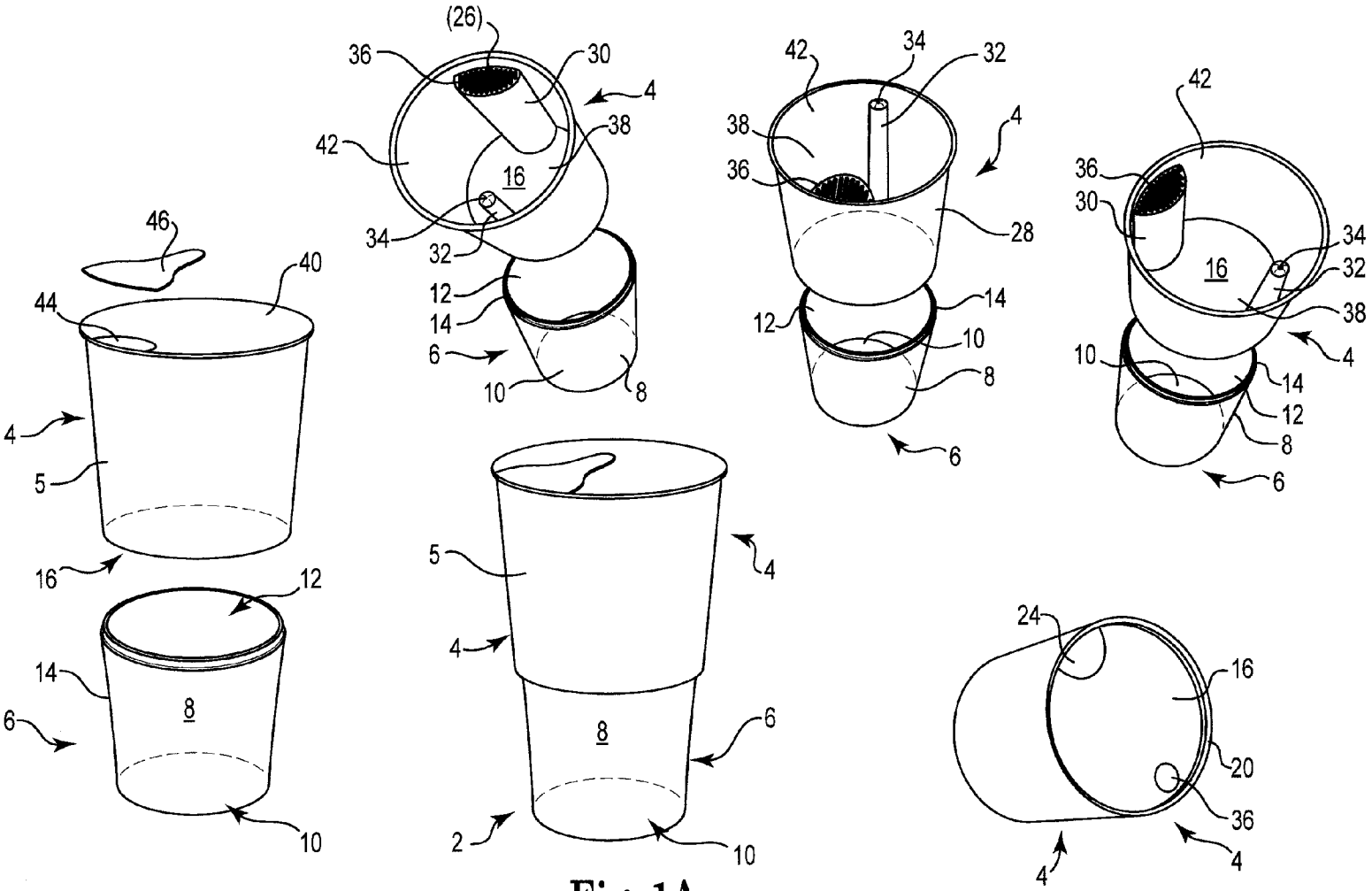
FIG. 1A illustrates various views of a package as described.
Figure 1B:
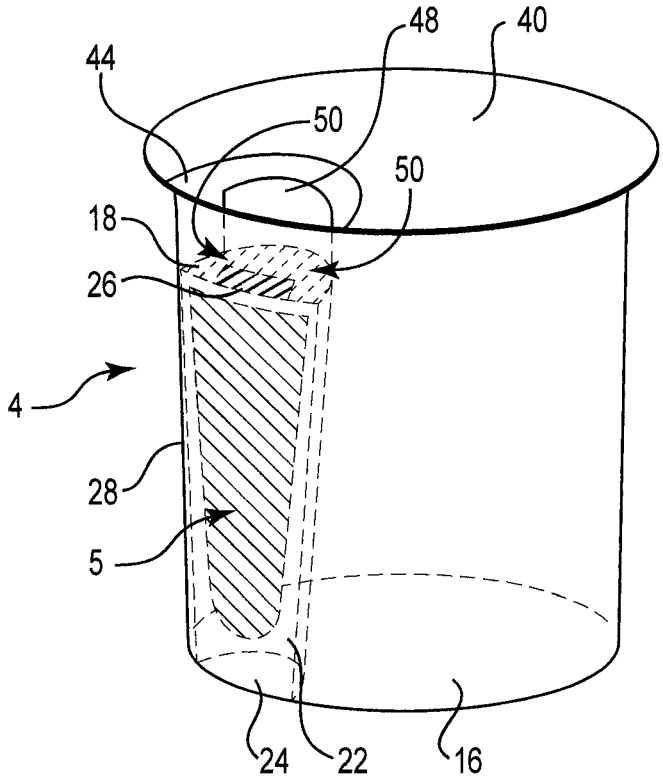
FIG. 1B is a side perspective view of a package as described.
Figure 1C:
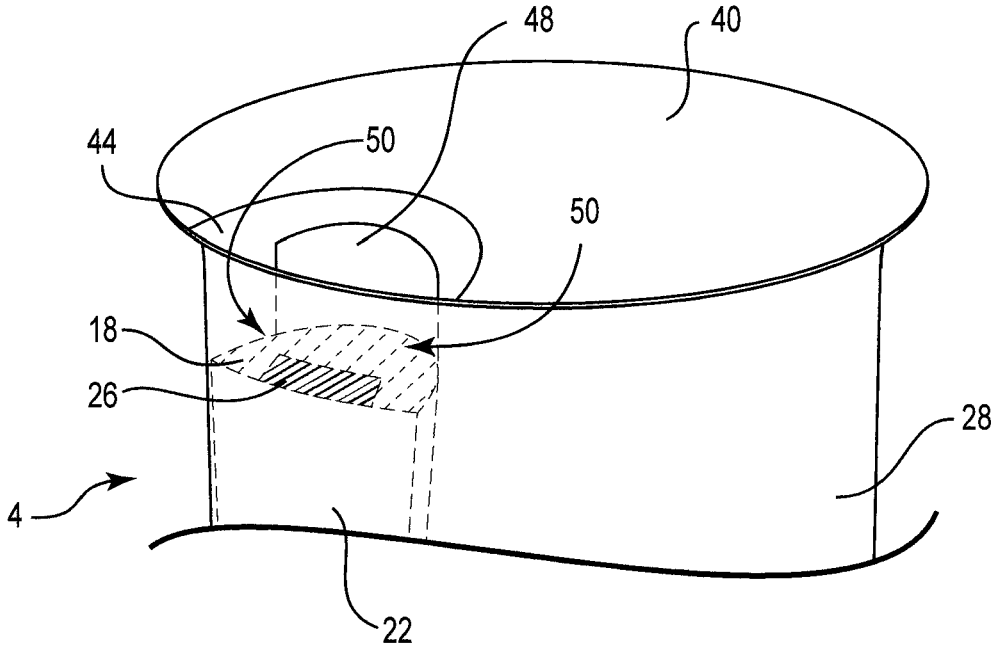
FIG. 1C is a side perspective view of a package as described.

Below are brief descriptions and sketches of exemplary designs of packages for storing, dispensing, or storing and dispensing dry cereal and milk for consumption.

"Holding Stage Embodiment A"

FIGS. 1A, 1B, 1C, and 1D show "Holding Stage Embodiment A," which is a one-handed design for separately containing milk and cereal in a manner that allows a consumer to dispense the milk and cereal together as a mixed stream through a single opening directly into the consumer's mouth.

The cereal and milk are stored separately in two containers of the package. Upon tipping the package to dispense the cereal and milk, the dry cereal enters a cereal holding stage that is within the package, milk passes through a milk channel and also enters the cereal holding stage to contact the cereal, the milk and cereal contact and mix within the cereal holding stage, and the cereal and milk (after coming into contact with each other within the package) are delivered from the package to the consumer.

In general, the package includes a lower container for milk and a separate upper container for dry cereal. Use of the package is simple and intuitive. The lower container is removed from its attachment at the bottom of the upper container. Optionally either milk is added to the lower container (if the package is sold without milk contained in the lower container) or if milk is already contained in the lower container a seal such as a foil (present to cover and seal the milk in the lower container) may be removed from the top opening of the lower container. The lower container can be re-connected to the bottom of the upper container. The upper container can be opened by peeling a tab or seal to allow access to a cereal holding stage, which in turn accesses the separate locations of the milk and the dry cereal. The product can be used to deliver cereal and milk in the same manner as a beverage dispenser (e.g., a can such as used for carbonated beverages) by dispensing a mixture of cereal and milk by tipping the container to cause the contents to empty from the top of the container into a user's mouth. (As used herein, a package is considered to be tipped "forward" by tipping a front side of a top of the package in a direction toward the user, with the front side being a side of the package that dispenses cereal and milk.) According to embodiments of the described packages, a combined mixture of dry cereal and milk, in desired amounts or combinations of amounts, can be delivered directly to a user's mouth.

An optional feature of the Holding Stage Embodiment A package is the capability to deliver milk as a continuous and constant stream at a desired, pre-determined average flow-rate, through a restricted opening. The amount of milk delivered can be controlled by the amount of time that the user holds the package in the tipped position, to allow a steady stream of milk to be delivered. Milk will flow continuously through a milk channel extending from the lower container and through the upper container but not in contact with the dry cereal while in the milk channel. The milk is continuously delivered from a milk port located in the upper container, for as long as the package is in the tipped position. A continuous flow is achieved by equalizing pressure within the lower (milk) container as milk exits the lower container. Pressure equalization can be accomplished, e.g., by venting the lower container. The flow rate of the continuous flow can be controlled by selecting the size of the opening through which milk is delivered at the top of the upper container and the size of the air vent.

An amount and rate at which dry cereal is delivered from the package can optionally be affected or controlled to result in a desired volume ("dose") of cereal delivered each time the package is tipped. Control of the amount and rate of cereal delivery may be affected by factors generally including the size (volume) of a cereal holding stage near the upper cover opening, the size of side passages (see below) through which cereal passes into the cereal holding stage, and whether or not a cereal bridge forms at a side passage during flow of cereal. The cereal holding stage is located within the upper container and near the top of the upper container in the internal space of the upper container and in communication with the upper container internal space, near the upper cover opening and also at the top of (above) the milk channel. In certain embodiments, a package can be designed to deliver approximately the same amount or "dose" of cereal each time a user tips the package to deliver cereal and milk; when the package is tipped, an amount of cereal becomes delivered from the upper container interior space to the cereal holding stage (i.e., becomes pre-staged), and this amount of cereal becomes the next to be delivered the next time the package is tipped; optionally, cereal delivery stops or is interrupted upon formation of a cereal bridge.

The amount and rate of cereal delivery can also be affected by the size and density of the dry cereal pieces. The size of cereal pieces can be selected to cause a desired flow or flow rate through passages for delivery. The size of cereal pieces may also be selected to create a cereal "bridge" to interrupt cereal flow even while the package remains tipped. For example, a package can be designed to result in the formation of a cereal bridge to stop cereal flow after a desired amount (one "dose") of cereal is dispensed. A cereal bridge may form during dispensing of the cereal when the package is tipped, such as at a side passage (see below) or at another opening through which cereal pieces flow. The size of a side passage or other opening that results in formation of a cereal bridge depends on the size of cereal particulates (pieces). Larger cereal particulates require a larger opening to allow a desired dose delivery followed by formation of a cereal bridge. An opening size may be selected to allow a volume of cereal that is approximately one heaping teaspoon (alternately, a volume equal to the volume of the cereal holding stage) to be dispensed to the user with each tip of the package, then for a cereal bridge to form and stop the flow of cereal.

An overall design of a "dosing" mechanism for delivery of a desired pre-determined amount of cereal, interrupted by formation of a cereal bridge, can be based on features that include selection of the size of the opening of a side channel leading to a cereal holding stage, and the size, shape, and density of cereal pieces. The mechanism is based on the tendency of particulates (cereal pieces) to bridge across an opening if their size is smaller than the opening, but still large in relation to the opening, and if the flow rate is sufficiently rapid. Formation of a cereal bridge can be used in the present application as a cereal delivery control mechanism in this package design. The control mechanism can be made to occur when an average diameter of cereal pieces is from about 25 to about 95, e.g., from about 75 to 95 percent of a dimension of an opening; if the opening is not square or round the relevant dimension is the smallest dimension of the opening.

Certain features related to the use of the cereal package of FIGS. 1A, 1B, 1C, and 1D include the following. Cereal and milk are contained in separate containers until dispensed, e.g., until a user dispenses a desired amount of cereal and milk directly into the mouth of the user by tipping the container. The package can be sold (e.g., prepared, stored, transported, and packaged) with milk contained in lower container, or alternately with the lower container empty. If the lower container is sold without milk, a consumer can add milk by detaching the lower container, placing milk in the lower container, and reattaching the lower container to the upper container. The cereal and milk are consumed by manipulating the package by tipping the package to deliver contents directly to the user's mouth in a manner similar to drinking from a cup or a soda can. Cereal and milk are delivered from their respective containers within the package, to a cereal holding stage near the opening at the top of the package. The cereal holding stage is located at an upper end of a milk channel so the cereal and milk are mixed within the cereal holding stage, just prior to delivery from the package. An amount of cereal that is delivered by tipping the package is a volume similar to the volume of the cereal holding stage. The amount, or "dose" delivered by a single tip of the package can optionally be interrupted by formation of a cereal bridge at the side passages. An increased amount of cereal may be delivered by optional manipulation (shaking) of the package, if desired.

Referring to FIG. 1A, a combined milk and cereal package 2 includes two separate containers, upper container 4 and a lower container 6. Lower container 6 includes lower container sidewalls 8, lower container bottom 10, and lower container top opening 12, and can be engaged and sealed against upper container bottom 16 of upper container 4. As illustrated, the sealing engagement between upper container bottom 16 and lower container top opening 12 of lower container 6 is a threaded engagement that produces a water-tight seal; the engagement is between lower threads 14 of lower container 6 and upper threads 20 of upper container 4 (this engagement may alternately be a press-fit engagement, a snap-fit engagement, or any other mechanical or adhesive fitted engagement). Upper cover 40 covers upper container opening 42, and includes upper cover opening 44, which can on turn be covered by opening cover 46. Upper cover 40 and opening cover 46 can be made of plastic, paper, cardboard, foil, etc., with adhesive placed at one or more surfaces to secure a perimeter of upper cover 40 to a lip or edge of upper container 4, and to secure opening cover 46 to upper cover 40 to cover and close (e.g., seal) upper cover opening 42.

Lower container 6 is designed to hold milk during use. Optionally, milk can be contained in lower container 6 during transport or storage, in which instance the milk may be sealed in a separate package (e.g., a plastic bag or paper or cardboard carton or container) or a seal may be placed across opening 12 to seal the milk for refrigerated or ambient temperature storage.

Upper container 4 includes various features that may allow for improved delivery of cereal and milk relative to earlier products designed to store and deliver milk together with dry cereal. Generally, interior space 38 of upper container 4 functions to contain dry cereal during use. Upper container 4 is defined at different portions by bottom 16, upper container sidewalls 28, and upper container top opening 42. A front of the upper container includes optional flat portion 5 that may assist in holding or aligning the package for tipping and delivery of cereal and milk.

Additional features of upper container 4 include milk channel 22 that extends from lower milk channel opening 24 at bottom 16, to milk port 26. Milk channel 22 allows milk to flow from lower container 6, through milk channel 22, and be delivered to cereal holding stage 36 to be combined with dry cereal and delivered from upper container 4 to the mouth of a consumer by tilting cereal package 2. Milk channel 22, as shown, e.g., at FIG. 1A, extends from bottom 16, starting at lower milk channel opening 24, vertically along upper container sidewall 28, to milk port 26 at shelf 18, and is further defined by internal milk channel wall 30 (wall 30 is illustrated to be rounded in cross-section, but may alternately be angular or linear). Shelf 18 extends horizontally relative to sidewall 28 and milk channel wall 30. As illustrated, milk channel 22 does not extend completely to the top of sidewall 28 but ends at shelf 18 (which defines the bottom of cereal holding stage 36). Interior space 38 of upper container 4 is defined in part by bottom 16, sidewalls 28, and internal milk channel wall 30.

Air vent 32 allows air to flow between upper container 4 and lower container 6, to equalize pressure within lower container 6 during delivery of milk from lower container 6. An air vent can be any structure that allows air to pass into lower container 6, which is otherwise sealed, as milk is delivered from lower container 6. For example, a vent can be a straw or channel ending at any location within upper container 4 or any other location external to lower container 6 that exhibits an ambient pressure. Pressure equalization produces consistent and smooth flow of milk through milk channel 22. As illustrated in FIG. 1A, upper air vent opening 34 is located at the upper space of interior space 38 of upper container 4, and lower air vent opening 36 is located to communication with the air contained in sealed lower container 6; these openings are connected by air vent 32 which may be a straw or channel.

At the top of milk channel 22 and within interior space 38 of upper container 4, so as to be accessible to cereal contained in upper container 4, is cereal holding stage 36. Cereal holding stage 36 is generally a space located above stage 18, within upper container 4, at the top of milk channel 22, also defined on a front side by sidewall 28, partially on a rear side by wall extension 48 and partially on one or more side by side passages 50. Wall extension (48) need not extend all the way up to contact upper cover 40, but should be sufficiently close to prevent flow of cereal pieces over the wall, e.g., less than within the average diameter of cereal pieces. Cereal holding stage 36 is accessible through upper covering opening 44, through which cereal and milk can be dispensed by tipping container 2, after cereal and milk are contacted with each other at cereal holding stage 36. Cereal holding stage 36 also is connected to interior space 38 in a manner to allow cereal to be transferred from interior space 38, into cereal holding stage 36, by manipulating cereal package 2, then further dispensed from package 2 at upper cover opening 44 by tipping package 2. As illustrated, side passages 50 are located laterally from wall extension 48, between edges of wall extension 48 and a front side of upper container sidewall 28.

Side passages 50 are sized to allow movement of cereal pieces from interior space 38 into cereal holding stage 36. Optionally, side passages are sized to allow free movement of cereal pieces into holding stage 36 for a desired amount of time, or for a desired amount of cereal, followed by formation of a cereal bridge at one or both side passages, to interrupt or stop further flow of cereal through side passages 50. The cereal bridge can be shaken loose, if desired, by the user, to deliver more cereal.

When the package 2 is transferred back to a vertical position from the tipped position used for dispensing, any amount of cereal that is in the cereal holding stage may remain there for delivery when the package is tipped the next time. Any milk that might remain in the cereal holding stage will be passed back through milk port 26 and return through milk channel 22 to lower container 6; re-separating the milk and cereal prevents the cereal from becoming soggy while being held at the cereal holding stage.

During use, when package 2 is tipped forward by a user in a manner to cause upper cover opening to be located below the contents of package 2, and toward the user's mouth, milk flows from lower container 6 through milk channel 22, through milk port 26 of shelf 18, to enter cereal staging space 36. Cereal enters cereal holding stage 36 from interior space 38 through side passages 50. The milk and cereal can be caused to flow into cereal holding stage 36 by user manipulation of package 2, especially by tilting the front part of package 2 (the side with milk channel 22 and cereal holding stage 36) forward. Upon continued tilting the mixture of milk and cereal is delivered from package 2 by passing through upper cover opening 44.

One optional feature of the design of cereal package 2 is improved control of the amount of cereal ("dose") delivered to a consumer upon each instance of tilting the package. A cereal dose size can be controlled by factors that include the size of cereal holding stage 36 and side passages 50, as well as the size and density of cereal pieces, and optionally but not necessarily by formation of a cereal bridge. A total amount of cereal delivered will be an amount contained in the cereal holding stage, and any additional amount that can be caused to flow from interior space 38 of upper container 4, through side passages 50, through cereal holding stage 36, and then out of upper cover opening 44, while package 2 is maintained in a tipped position. Optionally cereal size and the size of side passages 50 may result in formation of a cereal bridge at side passages 50, after a certain amount of cereal is delivered, which may interrupt cereal delivery; cereal flow may be restarted by manipulation of package 2 by shaking, rolling, or additional tipping, to disrupt a cereal bridge and encourage additional flow of cereal from interior space 38.

The size (e.g., volume) of a cereal holding stage can be any size that allows a desired flow of cereal into and through the holding stage; an exemplary volume can be, e.g., from 0.25 to 1 cubic inch. Exemplary dimensions of a shelf, which can correspond to the bottom dimensions of a cereal holding stage, can be a combination of a width and a depth each independently within the range from 0.5 to 1.5 inch. Exemplary height of a cereal holding stage can be in the range from 0.375 to 0.75 inch. Exemplary dimensions for each of the two side passages 50 can be, e.g., from about 0.1 to 0.5 square inch. Exemplary size and shape of cereal pieces used in combination with these dimensions of a cereal holding stage can be substantially round cereal pieces having average diameter in the range from 0.2 to 0.5 centimeter.

Another optional feature of the design of cereal package 2 is to control the rate and uniformity of a flow of milk delivered from milk port 26 to cereal holding stage 36 and to the user. The flowrate of milk through milk port 26 can be can be made substantially constant based on pressure equalization of the internal space of lower container 6, by flow of air through air vent 32, as milk exits lower container 6, which is sealed, through milk channel 22, air flows into lower container 6 through air vent 32 to equalize pressure.

The amount of milk (i.e., milk flowrate) can be controlled by factors that include the size of milk port 26. An exemplary milk flow rate can be, e.g., from 3.5 to 16 milliliters per second, and an exemplary milk port can be sized to achieve this flowrate.

A feature of the Holding Stage Embodiment A package is the ability to maintain dry cereal until right before use, i.e., until cereal and milk are dispensed together into cereal holding stage 36 and into a consumer's mouth. Keeping the cereal and milk separated during multiple dispensing (tipping) steps involving repetitive tipping can be a result of the milk being held back by the restricted size of milk port 26, which is only a portion of the size of shelf 18. When package 2 is set back to vertical from a tipped position, milk is directed back into lower container 6, through milk channel 22, to stay separated from the dry cereal in interior space 38 of upper container 4. This keeps the cereal dry and crunchy. One result is that cereal is only briefly wetted or prehydrated with milk at the time that the cereal is mixed with the milk in the cereal holding stage, into a combined stream of milk and cereal, and upon at delivery from upper covering 44 directly to a user's mouth.

See also FIG. 1D, which shows a package having many of the same features as that of FIG. 1A, with a difference being the location of upper air vent opening 34, air vent 32, and lower air vent opening 36 (the latter two of these not being shown at FIG. 1D). The package of FIG. 1D shows upper air vent opening 34 opening into cereal holding stage 36 in the form of a hole through shelf 18 on a posterior side of shelf 18. The upper air vent opening 34 connects through an air vent (not shown) or through the milk channel, leading to a lower air vent opening (not shown) (that may be lower milk channel opening 24) located to communicate with and equalize pressure in lower container 6.

"Holding Stage Embodiment A" with "Milk Bottle"

FIG. 2A illustrates a different version of a two-container package that includes features common to the Holding Stage Embodiment A package, additionally adapted to function in combination with a milk "chug" (or milk bottle, such as a commercially available plastic milk jug) that may be supplied separately from a container that contains a dry cereal. The cereal and milk are contained in two containers that can be sold or supplied together or separately, then attached together. Milk the dry cereal can be delivered as described in the Holding Stage Embodiment A embodiment, through a cereal holding stage that is within the package. The milk and cereal enter the cereal holding stage from separate packages, and contact and mix within the cereal holding stage. After mixing within the cereal holding stage the mixture of cereal and milk is delivered from the package to the consumer.

Referring to FIG. 2A, two-part package 72 includes upper container 74 containing cereal, and lower container ("chug" or "milk bottle") 76 containing milk. Upper container 74 includes multiple of the same features and functions as upper container 4 of FIG. 1A, including a milk channel, milk channel wall, shelf (extending horizontally from sidewalls of the upper container and the milk channel wall), interior space, and cereal holding stage. The milk channel allows milk to flow from lower container 76, through the milk channel, and be delivered from upper container 74 to the cereal holding stage and to the mouth of a consumer by tilting cereal package 72. The milk channel does not extend completely to the top of upper container 74 but ends at a shelf 18 that defines the bottom of cereal holding stage 36, which is also defined at a front side by an upper container sidewall, on sides by side passages that lead to an interior space of upper container 74, and on a back side by a wall extension extending from an internal milk channel wall that forms an internal portion of the milk channel (other portions of the milk channel being formed by sidewalls of upper container 74).

"Chug" 76 is a milk jug or plastic bottle that may be packaged or sold either separately or together with upper package 74, and may be shaped as a typical, standard, or standardized refrigerated or shelf-stable milk package. Opening 78 and threads 80 can be of standard sizes. Threads of adapter 82 engages threads 80 of chug 76 to seal the contents of chug 76. A second set of threads of adapter 82 also engage threads at a bottom of upper container 74 (this engagement may alternately be a snap-fit, press-fit, or adhesive fitted engagement). When adapter 82 is secured between upper container 74 and lower container 76, the contents of package 72 is sealed and can be dispensed according to the same method as described for the Holding Stage Embodiment A package of FIG. 1A. Dry cereal contained in upper container 74 is mixed with milk from lower container 76 by tipping package 72 to caused milk to flow through the milk channel and to cause dry cereal to pass through side channels and to the cereal holding stage, after which the milk and cereal are dispensed from the top of upper package 74 to a consumer. The air vent equalizes pressure in lower container 76 during delivery of milk to allow the milk to flow in a steady stream, and the size of a milk port at the top of the milk channel regulates the amount of milk delivered. The size (volume) of the cereal holding stage, shelf (shelf area), and side channels (areas), and the size and density of cereal pieces, can affect the amount of cereal delivered.

See also FIG. 2B, which shows a package having many of the same features as that of FIG. 2A, with a difference being the location of upper air vent opening 75, air vent 77, and lower air vent opening 79 (the latter two of these not being shown at FIG. 2B). The package of FIG. 2B shows upper air vent opening 75 opening into cereal holding stage 73, in the form of a hole through the shelf (unnumbered) that defines the lower and posterior side of cereal holding stage 73. The upper air vent opening 75 connects through an air vent (not shown) (which may optionally be the milk channel) leading to a lower air vent opening (not shown) (which may be the lower milk channel opening, unnumbered) that is located to communicate with and equalize pressure in lower container 76.

"Holding Stage Embodiment B"

Figure 3A:
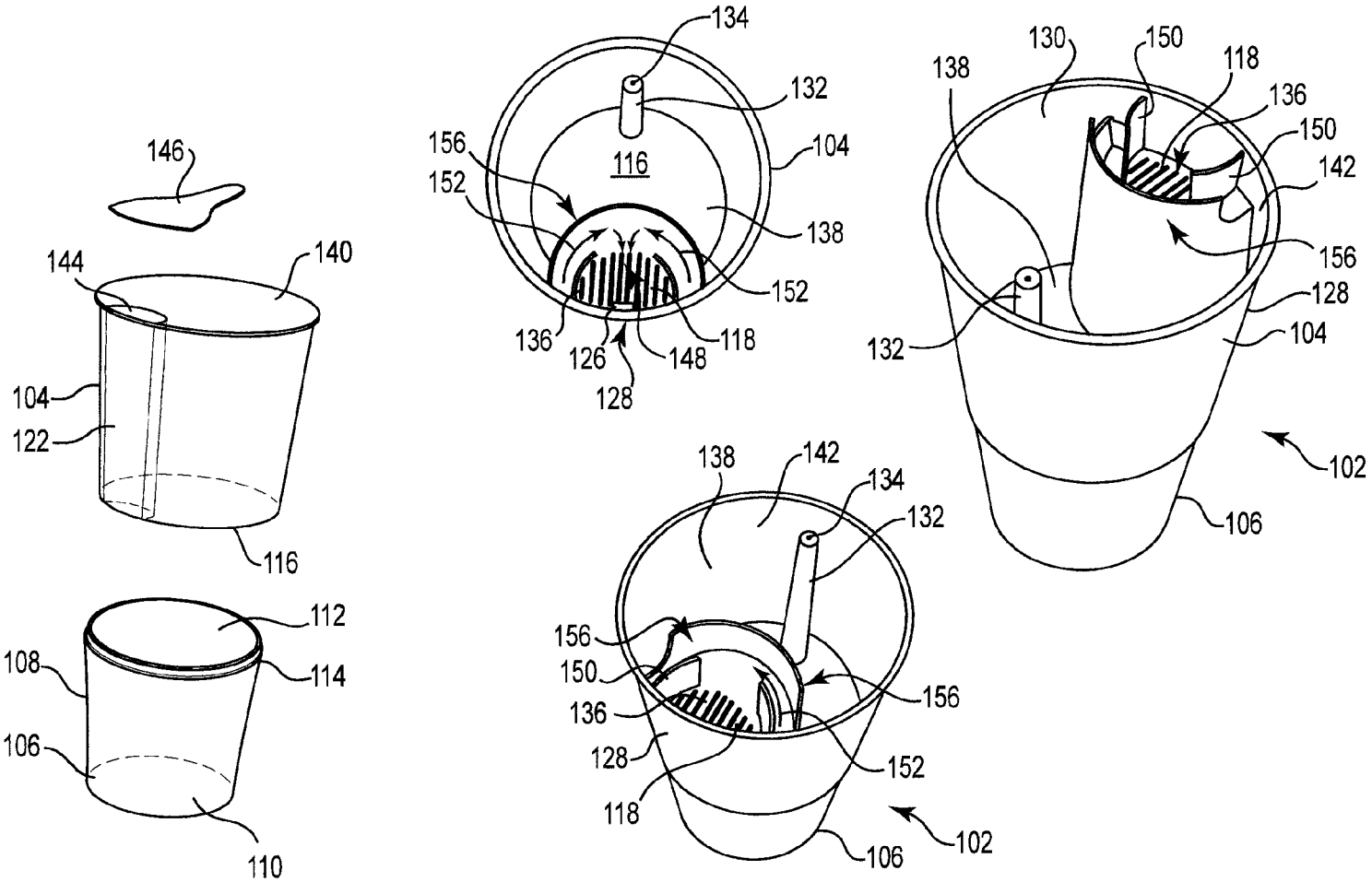
FIG. 3A illustrates various views of a package as described.
Figure 3B:
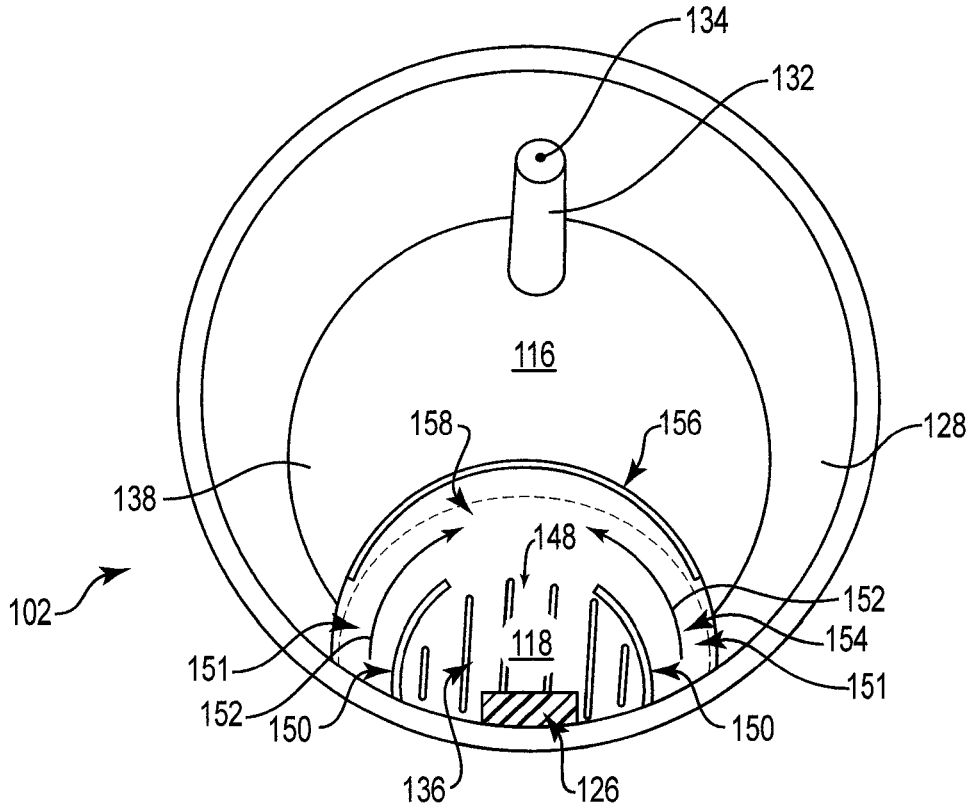
FIG. 3B is a top view of a package as described.
Figure 3C:
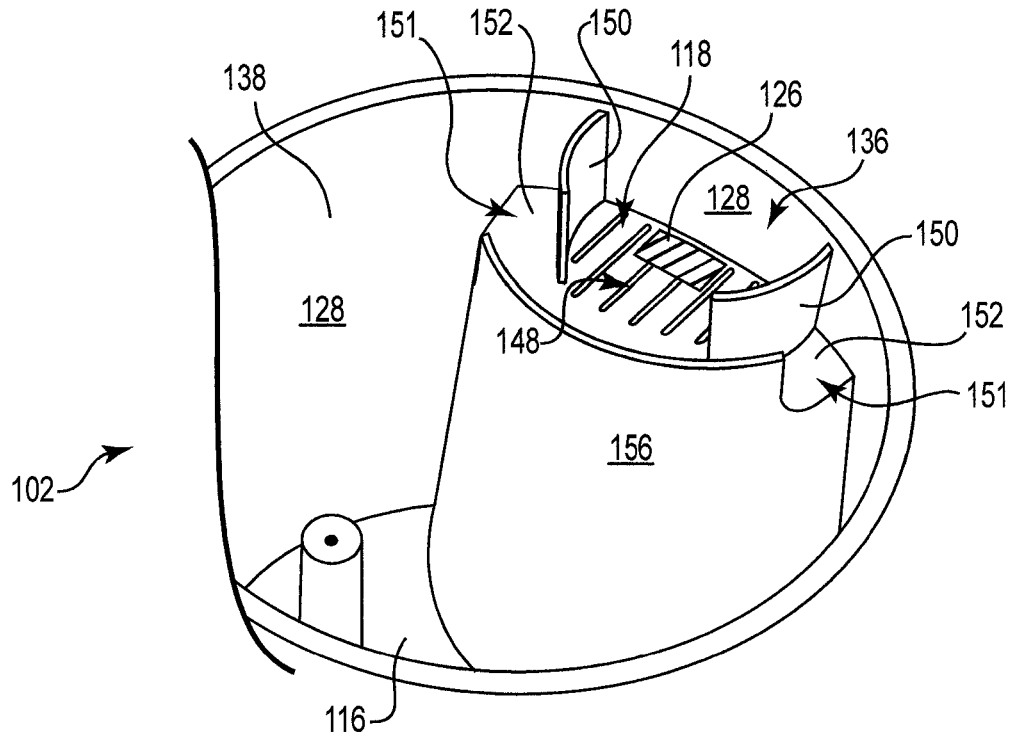
FIG. 3C is a top perspective view of a package as described.

FIG. 3A illustrates a different version of a two-container package that includes features common to the Holding Stage Embodiment A package but also contains additional features related to the cereal holding stage. The additional features provide an alternate cereal staging method that involves a pre-stage channel that connects the cereal holding stage and the upper container interior space. The pre-stage channel includes a channel bottom leading from the upper container interior space to the shelf of the cereal holding stage; the channel bottom surface can be substantially horizontal, or, alternately, may be gradually and uniformly (constantly) slanted toward the cereal holding stage. Portions of the pre-stage channel are bounded by vertical walls, and portions are not bounded by walls; the portions not bounded by vertical walls allow cereal to pass horizontally (when the package is in an untipped, vertical orientation) into or out of the channel.

An embodiment of a pre-stage channel can be defined in part by a vertical shelf wall located on an outer boundary of the shelf (the shelf defining the lower—horizontal when the package is untipped—boundary of the cereal holding stage) and on a side opposite of the shelf wall by a side passage that opens the pre-stage channel to the upper container interior space. The side passage can be defined on one edge (e.g., a front edge) by a sidewall of the upper container, and on another (e.g., interior) edge by a (vertical) outer channel wall. The vertical outer channel wall can border the pre-stage channel around an inner length of the pre-stage channel, and the inner length of the channel can lead to the cereal holding stage. The cereal holding stage can be bounded on a front side by a sidewall of the upper container, on lateral sides by two vertical shelf walls, and by a center passage that connects the cereal holding stage to the interior length of the pre-stage channel.

The features of the cereal holding stage and pre-stage channel of the Holding Stage Embodiment B package allow for a single dose of cereal to be delivered from the cereal holding stage during a single tip of the package, and can prevent additional cereal from flowing from the package upon shaking the package after delivery of the dose but without untipping the package. After the dose is delivered, the package can be re-oriented (i.e., un-tipped) to a vertical orientation upon which re-orientation cereal will flow from the upper container interior space, through a side passage, into and through a pre-stage channel, and into the cereal holding stage, where the cereal is staged for delivery during the subsequent step of tipping the package.

Referring to FIGS. 3A, 3B, 3C, and 3D, combined cereal and milk package 102 includes two separate containers, upper container 104 and a lower container 106. Lower container 106 includes lower container sidewalls 108, lower container bottom 110, and lower container top opening 112 at the top, and can be engaged and sealed against upper container bottom 116 of upper container 104. As illustrated, the sealing engagement between upper container bottom 116 and lower container top opening 112 of lower container 106 is a threaded engagement that produces a water-tight seal; the engagement is between lower threads 114 of lower container 106 and upper threads 115 of upper container 104. Upper cover 140 covers upper container opening 142 and includes upper cover opening 144 at a front side of container 102, which can in turn be covered by opening cover 146. Upper cover 140 and opening cover 146 can be made of a plastic, paper, or foil film with adhesive placed at one or more surfaces to secure a perimeter of upper cover 140 to a lip or edge of upper container 104, and to secure opening cover 146 to upper cover 140 to cover and close (e.g., seal) upper cover opening 142. Milk channel 122 is defined in part by upper container sidewall 128 and by internal milk channel wall 130, and allows milk to flow from lower container 106 to milk port 126 of shelf 118, without contacting cereal of interior space 138.

Air vent 132 allows air to flow between upper container 104 and lower container 106 to equalize pressure between these containers upon flow of milk out of lower container 106. As illustrated in FIG. 3, upper air vent opening 134 is located at the upper space of upper container interior space 138 of upper container 104, and lower air vent opening (not shown) is located to communicate with the interior space of sealed lower container 106; these openings are connected by air vent 132 which may be a straw or channel. Alternate embodiments of an air vent, such as shown and described with relation to FIGS. 1D and 2B, could alternately be used, whereby an upper air vent opening 134 is located at the top of milk channel 122 such as at a posterior location of shelf 118; the air vent can be the same as the milk channel and the lower air vent opening can be the lower milk channel opening.

At the top of milk channel 122 and within interior space 138 of upper container 104 and accessible to cereal contained in upper container 104 is cereal holding stage 136. Cereal holding stage 136 is generally the space located above (horizontal) stage 118, within upper container 104, at the top of milk channel 122, also defined on a front side by sidewall 128, on a rear portion by center passage 148 and on side portions by (vertical) shelf walls 150. Cereal holding stage 136 is accessible through upper covering opening 144, through which cereal and milk can be dispensed by tipping container 102 forward, causing cereal and milk to be contacted with each other at cereal holding stage 136, then to be delivered through opening 144.

Cereal holding stage 136 connected to pre-stage channel 152, which are defined in part by shelf walls 150, side passages 151, and outer channel wall 156. Pre-stage channel 152 includes side channel portions 154, which connect to upper container interior space 138 through side passages 151, and inner channel portion 156 located between side channel portions 154; inner channel portion 158 connects side channel portions 154 to cereal holding stage 136, through center passage 148.

Side passages 151 and pre-stage channel 152 are sized to allow movement of cereal pieces from interior space 138, through pre-stage channel 152, and into cereal holding stage 136 based on gravity.

During use, when package 102 is tipped forward, milk flows from lower container 106 through milk channel 122, through milk port 126 of shelf 118, to enter cereal holding stage 136. Cereal enters holding stage 136 from pre-stage channel 152. When the package 102 is tipped, cereal falls through side passages 151 and rests against shelf walls 150, thereby entering into pre-stage channels 152. The package may be tipped down to cause cereal to move to internal portion of channel 152, then tipped up again to get cereal to cereal holding stage 136. By this series of up and down tipping steps, cereal can be delivered in doses. Optionally, a package may be stored or sold with cereal already placed in the cereal holding stage (i.e., "pre-staged"), to be present as a first dose of cereal. For example, a package may be shipped upside down to place cereal in the cereal holding stage.

The milk and cereal can be caused to flow into cereal holding stage 136 by user manipulation of package 102, especially by tilting the front part of package 102 in a forward direction (toward the user). By tilting and optionally re-tilting the package, the mixture of milk and cereal is delivered from package 102 by passing through upper cover opening 144.

Cereal dose size delivered from package 102 can be controlled by factors that include the size of cereal holding stage 136 and the size and density of cereal pieces. A total amount of cereal delivered will approximate and amount contained in the cereal holding stage.

An exemplary size of a cereal holding stage 136 can be the same as described above for cereal holding stage 36. An exemplary sizes for the total volume of pre-stage channels can be approximately the same size as a cereal holding stage, or up to 50 percent larger. A useful size for each of the two side passages 151 can be, e.g., from 0.1 to 0.5 square inch.

The design of cereal package 102 may also include control of the rate and uniformity of flow of milk delivered from milk port 126. The flowrate of milk through milk port 26 can be can be made constant based on pressure equalization of the internal space of lower container 106, by flow of air through air vent 132; as milk exits lower container 106, which is sealed, through milk channel 122, air flows into lower container 106 through air vent 132 to equalize pressure. The amount of milk (i.e., milk flowrate) can be controlled by factors that include the size of milk port 26, and may be sized to provide a flow in the range from 3.5 to 16 milliliters per second.

The overall design allows prevents the milk from contacting the cereal until delivery, and prevents the milk from causa user to deliver a desired combination of milk and dry cereal from a container that ing the cereal to become soggy.

Figure 3D:
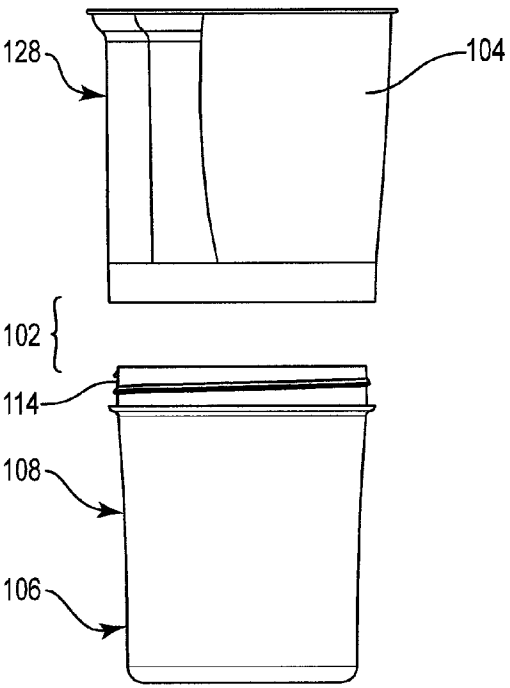
FIG. 3D includes top, side, and side cut-away views of a package as described.
Figure 3D:
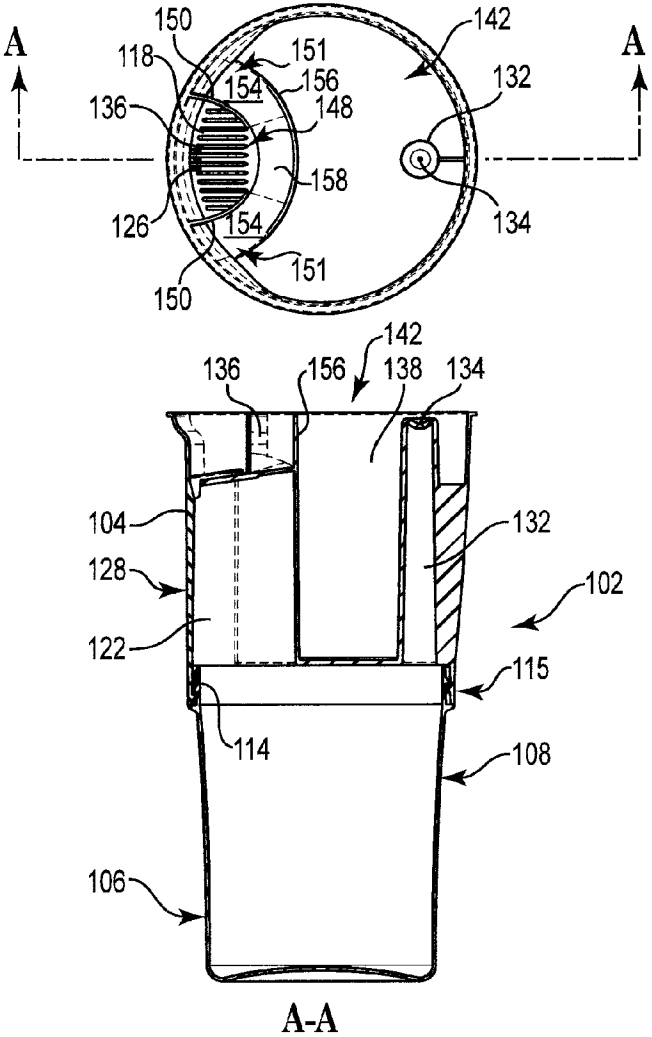

See also FIG. 3D.

"Hybrid A"

Figure 4A:
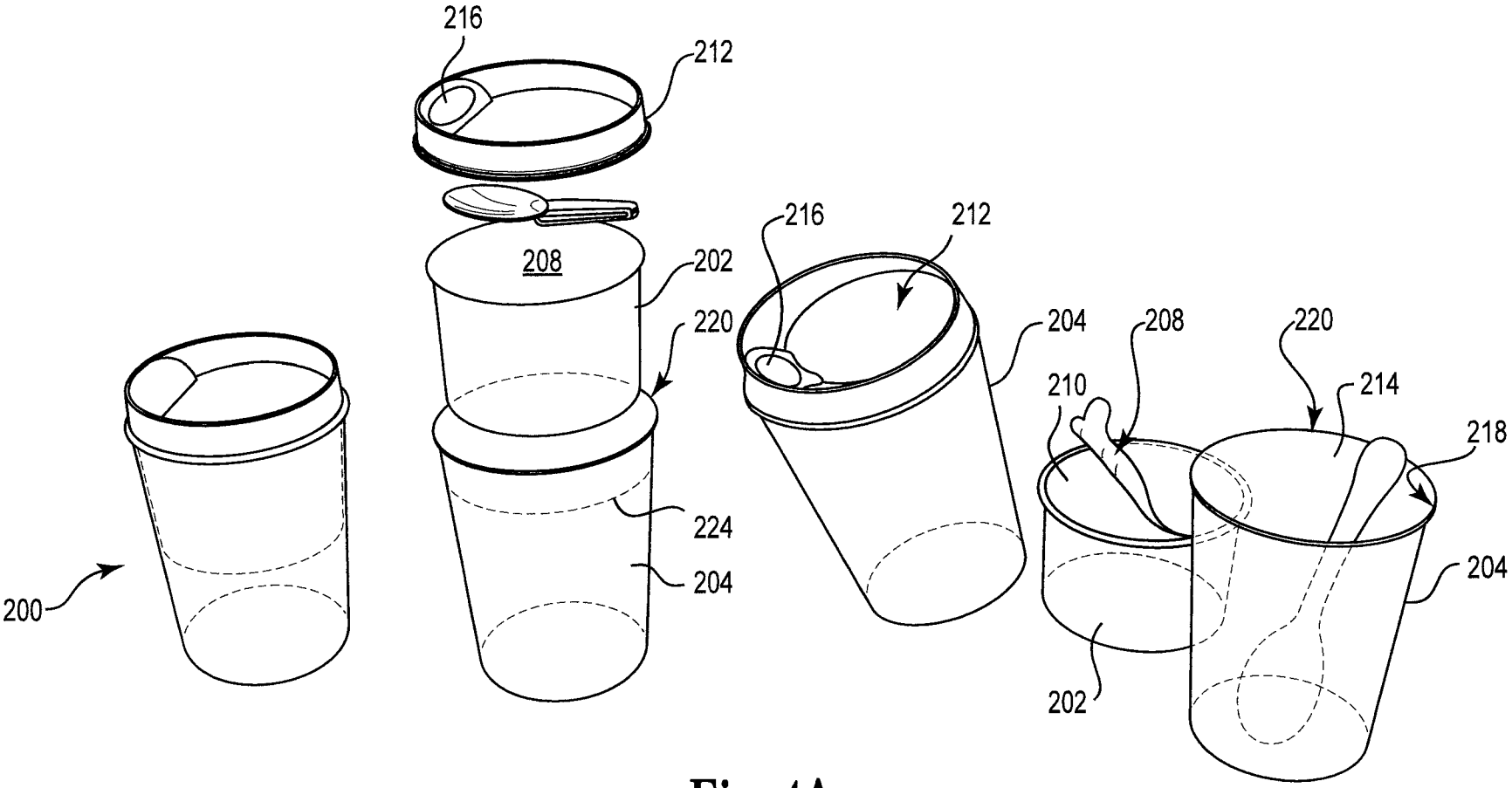
FIG. 4A illustrates various views of a package as described.
Figure 4B:
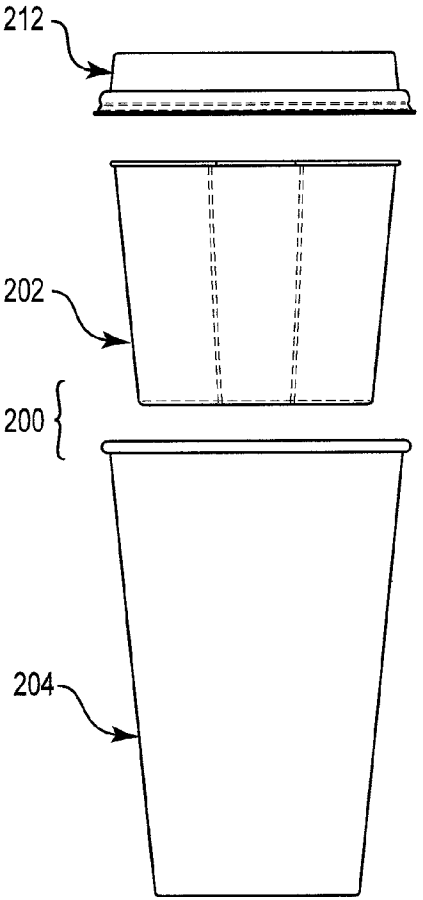
FIG. 4B includes top, side, and side cut-away views of a package as described.
Figure 4B:
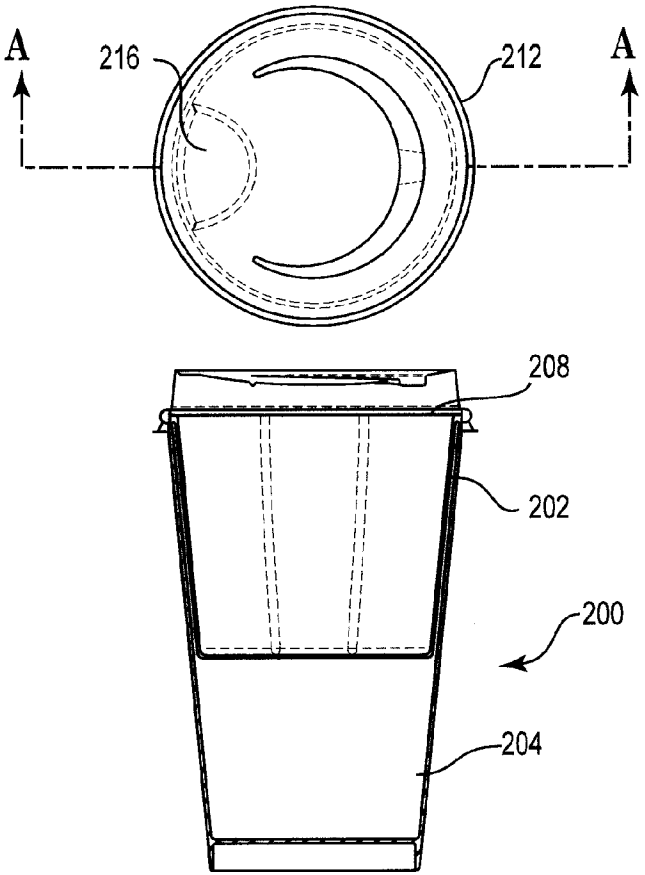

Another embodiment of a combined cereal and milk package is illustrated at FIGS. 4A and 4B, designated "Hybrid A." Features of Hybrid A can include a package that can be stored, transported, offered for sale, purchased, and used, while containing dry cereal and optionally milk for consumption in separate containers. The milk may be refrigerator-stable or shelf stable milk. The upper container can contain milk in a sealed upper container that nests into the lower container. The lower container supports the upper container, e.g., at an upper interior portion of the lower container, and additionally contains dry cereal at a lower portion of the lower container. A removable cover such as a foil, paper, or cardboard film or membrane covers and seals a top opening of the upper container to seal the upper container and the contained milk. A lid (e.g., plastic) covers the upper opening of the lower container, while the lower container contains the upper container. The lid can include a space for containing an eating implement (e.g., spoon), and optionally a napkin, between the lid and the upper container (at the top of the lower container), and can also include a lid opening that can be used to deliver cereal and milk to a user by tipping the container toward the user's mouth. During use, the upper container, containing milk, is removed from within the lower container, which contains dry cereal. A cover of the upper container is removed to expose milk in the upper container. The milk is poured into the lower container to produce a mixture of milk and cereal. The mixture of milk and cereal can be consumed in a conventional manner by use of a spoon to remove milk and cereal from the lower container, as with a conventional cereal bowl. Alternately, the lower container lid may be re-placed on the top opening of the lower container and a mixture of milk and cereal can be delivered to a user by a one-handed method through an opening in the lid by tipping the lower container toward the user's mouth.

Referring to FIG. 4A, package 200 includes upper container 202 and lower container 204. Upper container 202 can contain milk, which can be refrigerator stable or shelf stable, for storage, marketing, transport, and sale to a consumer. Upper container 202 includes top opening 214. Lower container 204, nested within upper container 202, can contain dry cereal for storage, marketing, transport, and sale to a consumer for consumption. Upper container 202 includes opening 210, covered and sealed by removable (e.g., peelable) cover 208 that may be made of plastic, paper, or foil, and that is secured lower container 204, e.g., by adhesive, to cover opening 210.

Top opening 214 of upper container 202 is covered by removable lid 212, which includes opening 216. During storage, upper container 202 can be held by lower container 204, i.e., nested, by an internal flange (224, as illustrated), shelf, or one or a plurality of pegs or other mechanical extensions extending from internal sidewall 218, or alternately may be held in place by a friction fit, in either instance, e.g., to sit at or below the upper edge 220 of the lower container 204.

See also FIG. 4B.

"Milk Container Adaptable Embodiment A"

Figure 5A:
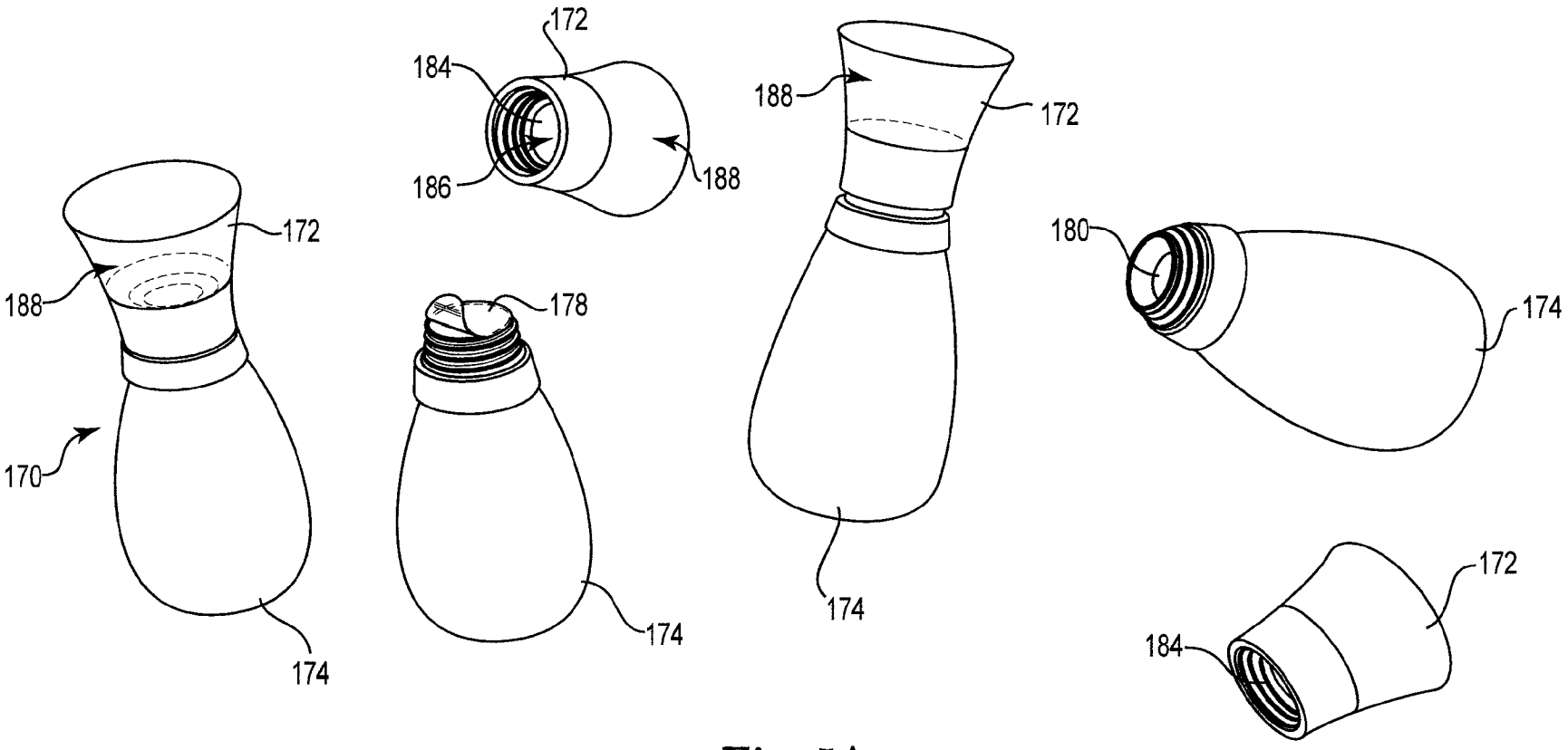
FIG. 5A illustrates various views of a package as described.
Figure 5B:
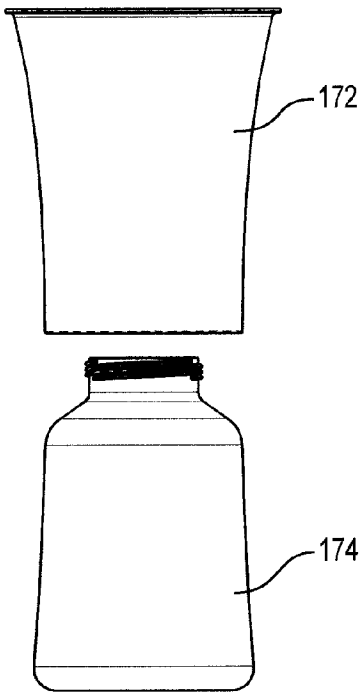
FIG. 5B includes top, side, and side cut-away views of a package as described.

Another embodiment of a combined cereal and milk package is illustrated at FIGS. 5A and 5B, designated "Milk Container Adaptable Embodiment A." Features of Milk Container Adaptable Embodiment A can include a package that can be stored and offered for sale, while containing dry cereal and milk for consumption, each in a separate container. The milk may be refrigerator-stable or shelf stable milk. During use, the upper container, which contains the dry cereal, is removed from the lower container (milk chug). A cover such as a foil, that covers and seals the lower container, is removed.

Another cover can also cover the opening of the upper container, and can be, e.g., a breakable or dissolvable, edible film or edible membrane that is dissolved upon contact with a liquid (e.g., milk) or, that can be broken, shattered, or otherwise opened by mechanical contact with the dry cereal. When the upper container is re-secured to the lower container, the upper container cover continues to separate the milk in the lower container from the dry cereal in the upper container. The user shakes the package. The shaking may cause milk to contact the upper container cover and dissolve the cover or, alternately, the shaking may cause pieces of the dry cereal to mechanically contact and disrupt the upper container cover. After the upper container cover is dissolved or broken, cereal can pass from the upper container into the lower container to produce a mixture of cereal and milk in the lower container. The user can consume the mixture of milk and cereal from the lower container by tipping the container to deliver the cereal and milk directly to the consumer's mouth. Dissolvable materials useful for preparing dissolvable membranes of edible material are described, for example, in U.S. Pat. No. 6,221,402, the entirety of which is incorporated herein by reference.

Referring to FIG. 5A, package 170 includes upper container 172 and lower container 174. Upper container 172 can contain dry cereal for storage, marketing, transport, and sale to a consumer. Upper container 172 includes opening 184 and cover 186, which can dissolve upon contact with liquid. Lower container 174 can contain milk, which can be refrigerated or shelf stable, for storage, marketing, transport, and sale to a consumer. Lower container 174 includes opening 180, covered and sealed by removable (e.g., peelable) cover 178 that may be made of plastic, paper, or foil, and that is secured to opening 180 of lower container 174, e.g., by adhesive.

Opening 184 of upper container 172 engages opening 180 of lower container 174 in a sealing engagement that is tight to liquids. For example, and as illustrated, threads near opening 184 of upper container 172 engage opposing threads at opening 180 of lower container 174, to allow the two containers to be sealed together at their respective openings. Upper container 172 is shaped with a continuous curved, arcuate, non-jagged surface to maintain uninterrupted flow from the base to the mouth of the chamber. Concave sidewalls (188) are free of sharp turns and ledges, to facilitate flow of dry cereal from upper container 172, through openings 184 and 180, and into lower container 174.

In preferred embodiments an internal sidewall surface can be made of or coated to exhibit a of a low surface energy, e.g., a surface energy below about 50 dynes per centimeter, or less than 40 or 38 dynes per centimeter. Exemplary low surface area materials include polystyrene, polyvinylalcohol (PVA) polyethylene, polypropylene, and the like.

See also FIG. 5B.

"Milk Container Adaptable Embodiment B"

Figure 6A:
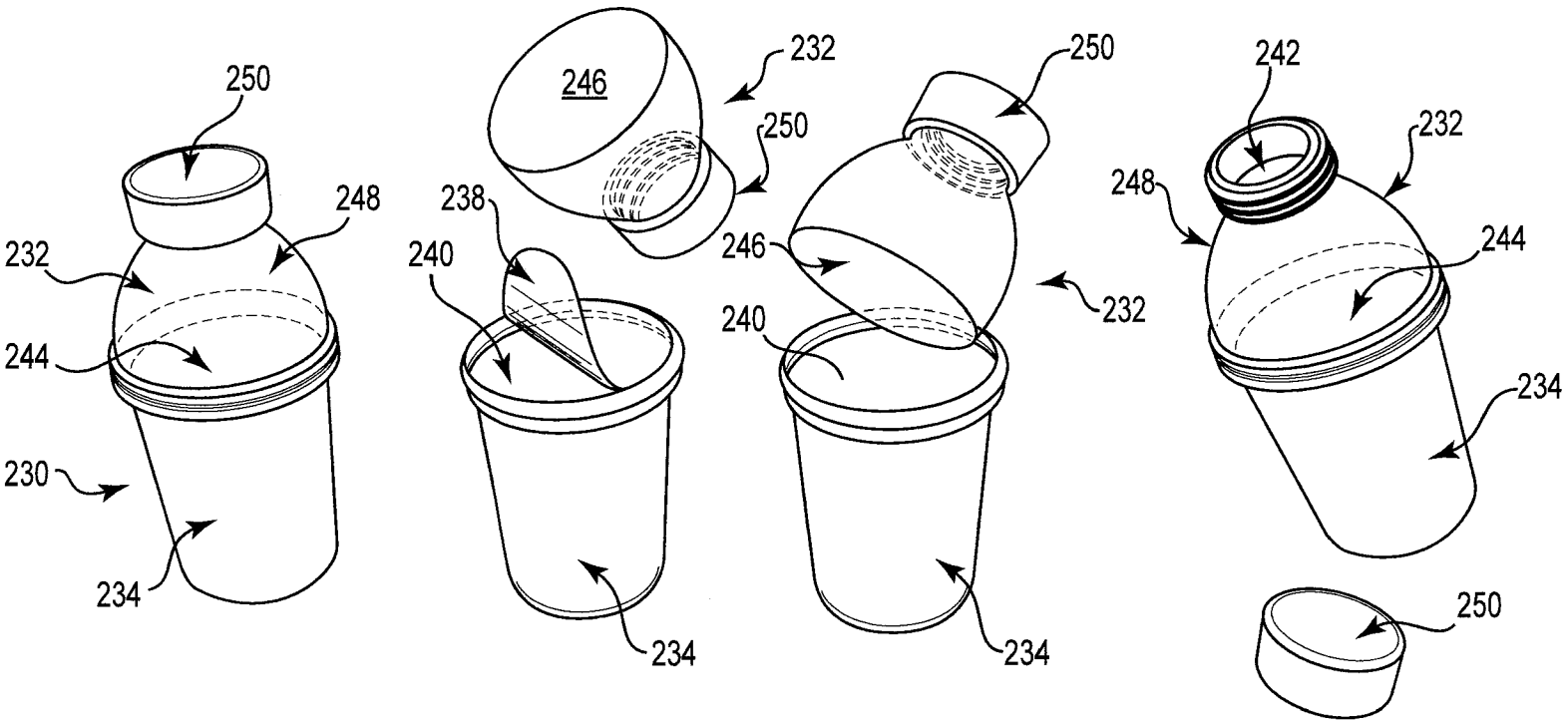
FIG. 6A illustrates various views of a package as described.
Figure 6B:
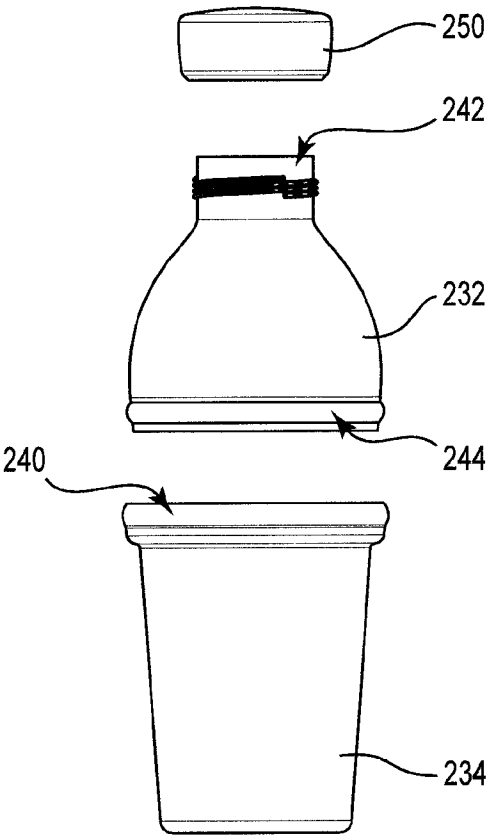
FIG. 6B includes top, side, and side cut-away views of a package as described.
Figure 6B:
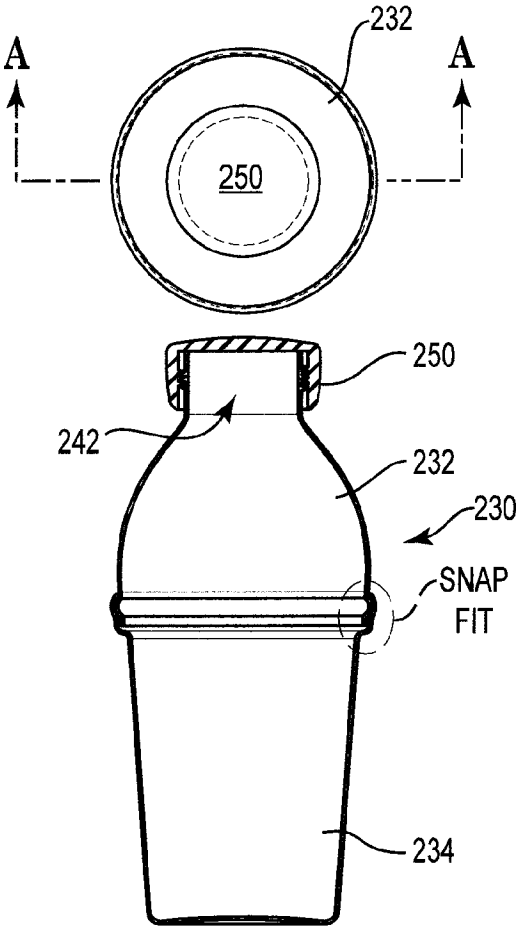

Another embodiment of a combined cereal and milk package is illustrated at FIGS. 6A and 6B, designated "Milk Container Adaptable Embodiment B." Features of Milk Container Adaptable Embodiment B can include a package that can be stored and offered for sale while containing dry cereal and milk for consumption, each in a separate container. The milk may be refrigerator-stable or shelf stable milk.

During use, the upper container, containing dry cereal, is removed from the lower container (milk chug). A cover such as a foil, that covers and seals the lower container, is removed. Another cover can also cover the opening of the upper container, and can be, e.g., a dissolvable or breakable film or membrane that can be dissolved upon contact with water or liquid milk or broken by mechanical contact with dry cereal. When the upper container is re-secured to the lower container, the upper container cover continues to separate the milk in the lower container from the dry cereal in the upper container. The user shakes the package. The shaking may cause milk to contact the upper container cover and dissolve the cover or, alternately, the shaking may cause pieces of the dry cereal to mechanically contact and disrupt the upper container cover. After the upper container cover is dissolved or broken, cereal can pass from the upper container into the lower container to produce a mixture of cereal and milk in the lower container. A cap is located at an upper opening of the upper container. The user can consume the mixture of milk and cereal from the package by removing the cap from the upper opening of the upper container and tipping the package to deliver the cereal and milk directly to the consumer's mouth, from an opening in the upper container.

Referring to FIG. 6A, package 230 includes upper container 232 and lower container 234. Upper container 232 can contain dry cereal for storage, marketing, transport, and sale to a consumer. Upper container 232 includes upper opening 242, sidewalls 248, bottom opening 244, and cover 246, which can dissolve upon contact with liquid. Cap 250 is engaged (e.g., by threads) to close upper opening 242. Lower container 234 can contain milk, which can be refrigerated or shelf stable, for storage, marketing, transport, and sale to a consumer. Lower container 234 includes opening 240, covered and sealed by removable (e.g., peelable) cover 238 that may be made of plastic, paper, or foil, and that can be secured to opening 240 of lower container 234, e.g., by adhesive.

Opening 244 of upper container 232 engages opening 240 of lower container 234 in a sealing engagement that is tight to liquids, for example by a threaded engagement or a snap fit. Upper container 232 is shaped to have convex sidewalls (248) to facilitate flow of cereal, milk, and wetted cereal, along sidewalls 248 without the wetted cereal sticking to the sidewalls. The convex shape of the upper container is selected to maintain uninterrupted flow from the base to the mouth of the chamber, and does not include any sharp turns, ledges, etc. After milk and cereal are mixed in lower container 234, cap 250 can be removed by the user and a mixture of cereal and milk can be dispensed from opening 242, e.g., directly to a user's mouth.

In preferred embodiments an internal sidewall surface can be made of or coated to exhibit a of a low surface energy, e.g., a surface energy below about 50 dynes per centimeter, or less than 40 or 38 dynes per centimeter. Exemplary low surface area materials include polystyrene, polyvinylalcohol (PVA) polyethylene, polypropylene, and the like.

Figure 6C:
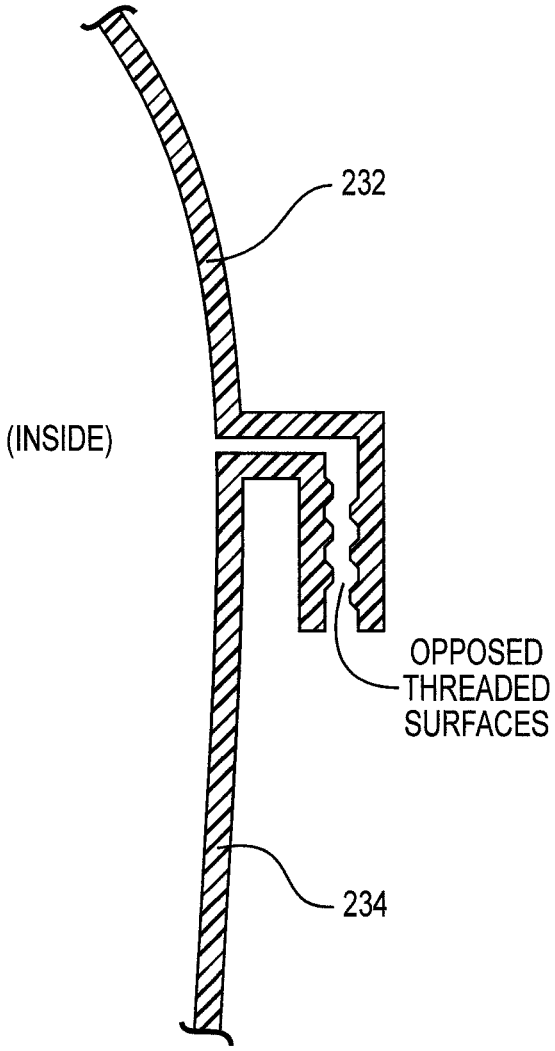
FIG. 6C is a side cut-away view of features of a package as described.

See also FIG. 6B. See also FIG. 6C, which shows threads used in place of a snap-fit for securing upper container 232 to lower container 234.

"Milk Container Adaptable Embodiment C"

Figure 7A:
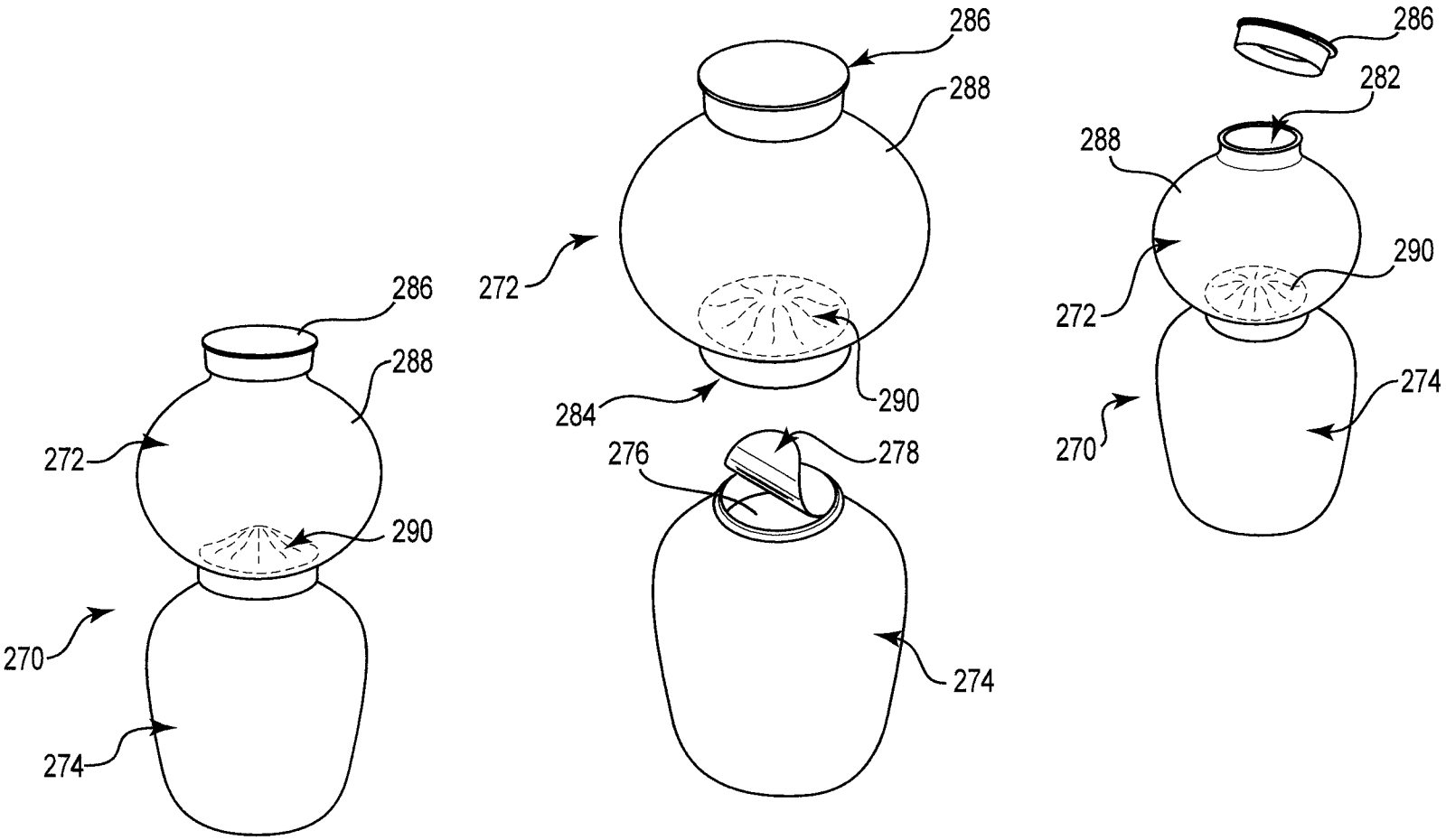
FIG. 7A illustrates various views of a package as described.

Another embodiment of a combined cereal and milk package is illustrated at FIGS. 7A and 7B, designated "Milk Container Adaptable Embodiment C." Features of Milk Container Adaptable Embodiment C can include a package that can be stored and offered for sale while containing dry cereal and milk for consumption, each in a separate container. The milk may be refrigerator-stable or shelf stable milk.

During use, the upper container, containing dry cereal, is removed from the lower container (milk chug or milk jug). A cover such as a foil, that covers and seals an opening in the lower container, is removed. A valve can cover a lower opening of the upper container at a location where the lower opening attaches to an upper opening of the lower container; the valve can include a mechanical screen that allows milk to flow through the valve but does not allow passage of pieces of cereal. A removable cap can cover an upper opening of the upper container. After the cover is removed from the lower container opening, the upper container is replaced on the opening with the valve now separating the interior space of the upper container from the interior space of the lower container, at the location where the lower opening of the upper container is attached to the opening of the lower container. The valve allows milk to pass from the lower container into the upper container, when the package is tipped. The removable cap located at an upper opening of the upper container can be removed and the user can consume the mixture of milk and cereal from the package by tipping the package to deliver the cereal and milk directly to the consumer's mouth, from the opening in the upper container. The valve that separates the upper container from the lower container allows milk to pass back into the lower container but keeps cereal in the upper container to maintain separation of the milk and cereal, preventing the cereal from becoming soggy.

Referring to FIG. 7A, package 270 includes upper container 272 and lower container 274. Upper container 272 can contain dry cereal for storage, marketing, transport, and sale to a consumer. Upper container 272 includes upper opening 282, sidewalls 288, bottom opening 284, cover 286 that covers upper opening 282, and valve 290 located within bottom opening 284. Cap 286 is engaged (e.g., by threads, a snap fit, or another mechanical or adhesive closure mechanism) to close and optionally seal upper opening 282. Lower container 274 includes opening 276, covered and sealed by removable (e.g., peelable) cover 278 that may be made of plastic, paper, or foil, and that can be secured to opening 276 of lower container 274, e.g., by adhesive. Lower container 274 can contain milk, which can be refrigerated or shelf stable, for storage, marketing, transport, and sale to a consumer.

Opening 284 of upper container 272 engages opening 276 of lower container 274 in a sealing engagement that is tight to liquids, for example by a threaded engagement or a snap fit. Upper container 272 is shaped to have convex sidewalls (288) to facilitate flow of cereal, milk, and wetted cereal, along sidewalls 288 without the wetted cereal sticking to the sidewalls. After cover 278 is removed and upper container 272 is re-attached to lower container 274, the package 270 contains milk in lower container 274 and dry cereal in upper container 272, with the milk and dry cereal being separated by valve 290, which has openings that allow milk to flow between the two containers but that do not allow cereal pieces to pass from upper container 272 into lower container 274. To dispense a mixture of cereal and milk, a user tips package 270 to cause milk to flow from lower container 274, through upper container 272 and out of opening 282, which also causes cereal to flow from upper container 272 out of opening 282; the mixture of cereal and milk can be dispensed from opening 282, e.g., directly to a user's mouth. The shape of the upper container is selected to maintain uninterrupted flow from the base to the mouth of the chamber. Sharp turns and ledges are undesirable.

See also FIG. 7B, which additional shows connector 273 placed between upper container 272 and lower container 274. See also FIG. 7C, showing a variation wherein the lower container has a widened upper opening. And connector 273 includes valve 290.

"Milk Container Adaptable Embodiment D"

Figure 8B:
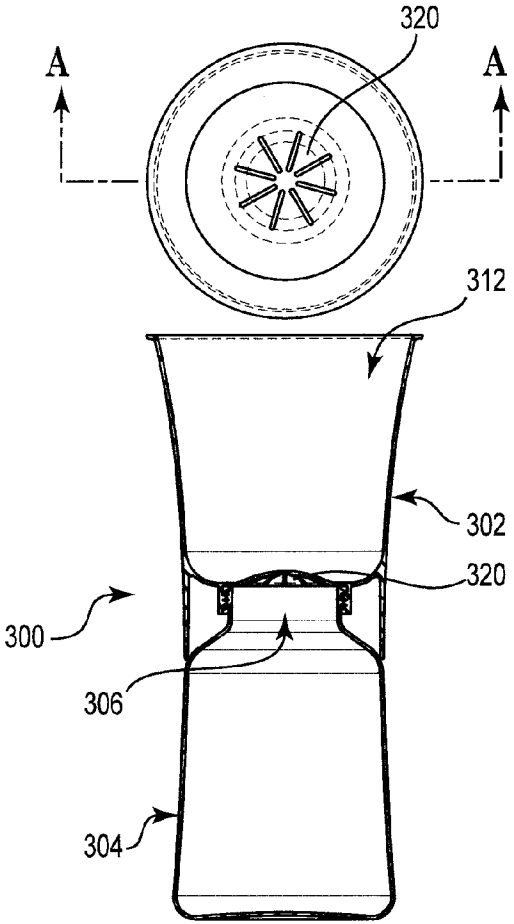
FIG. 8B includes top, side, and side cut-away views of a package as described.
Figure 8A:
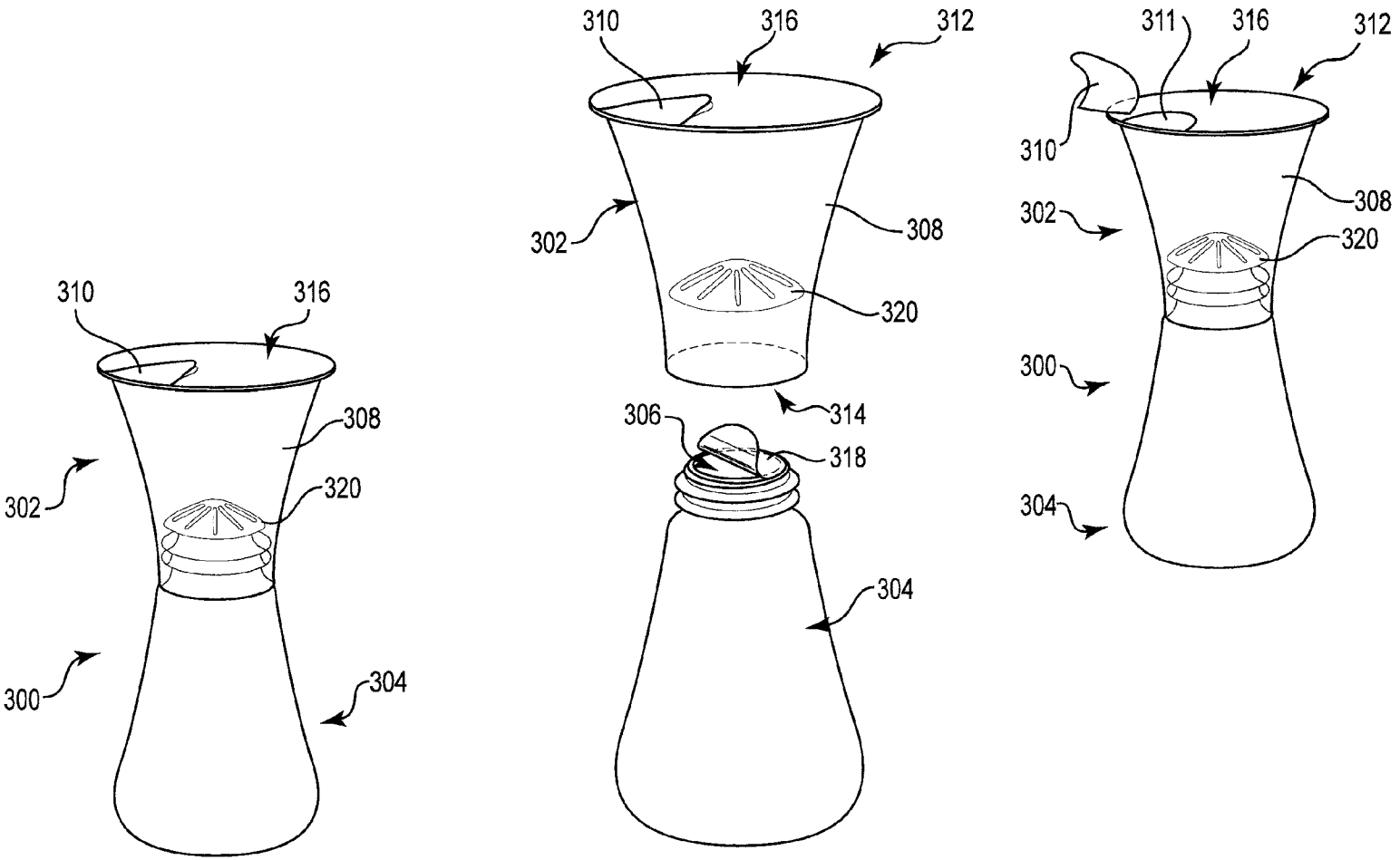
FIG. 8A illustrates various views of a package as described.

Another embodiment of a combined cereal and milk package is illustrated at FIG. 8A, designated "Milk Container Adaptable Embodiment D." Features of Milk Container Adaptable Embodiment D can include a package that can be stored and offered for sale while containing dry cereal and milk for consumption, each in a separate container. The milk may be refrigerator-stable or shelf stable milk. During use the upper container, containing dry cereal, is removed from the lower container (milk chug). A cover such as a foil that covers and seals an opening in the lower container is removed. A valve can cover a lower opening of the upper container at a location where the lower opening attaches to an upper opening of the lower container; the valve can include a mechanical screen that allows milk to flow through the valve but does not allow passage of pieces of cereal. A removable cover can cover and seal an upper opening of the upper container. After the cover is removed from the lower container opening, the upper container can be replaced on the lower container opening with the valve now separating the interior space of the upper container from the interior space of the lower container, at the location where the lower opening of the upper container is attached to the opening of the lower container. The valve allows milk to pass from the lower container into the upper container, when the package is tipped. The removable cap located at an upper opening of the upper container can be removed and the user can consume the mixture of milk and cereal from the package by tipping the package to deliver the cereal and milk directly to the consumer's mouth, from the opening in the upper container. The valve that separates the upper container from the lower container allows milk to pass back into the lower container but keeps cereal in the upper container to maintain separation of the milk and cereal, preventing the cereal from becoming soggy.

Referring to FIG. 8A, package 300 includes upper container 302 and lower container 304. Upper container 302 can contain dry cereal for storage, marketing, transport, and sale to a consumer. Upper container 302 includes upper opening 312, sidewalls 308, bottom opening 314, cover 316 that covers upper opening 312 except for opening 311, and tab 310 that covers opening 311 in cover 316. Cover 316 is adhesively secured to the upper rim of sidewall 306 around upper container 304, and tab 310 is adhesively secured to cover 316 around edges of opening 311 and the upper rim of sidewall 308 near opening 311. Valve 320 is located within opening 314 of upper container 302, and allows liquids (e.g., milk) to pass through in either direction, but does not allow cereal pieces to pass from upper container 302 into lower container 304.

Lower container 304 includes opening 306, covered and sealed by removable (e.g., peelable) cover 318 that may be made of plastic, paper, or foil, and that can be secured to opening 306 of lower container 304, e.g., by adhesive. Lower container 304 can contain milk, which can be refrigerated or shelf stable, for storage, marketing, transport, and sale to a consumer.

Opening 314 of upper container 302 engages opening 306 of lower container 304 in a sealing engagement that is tight to liquids, for example by a threaded engagement or a snap fit. Upper container 302 is shaped to have convex sidewalls (308) to facilitate flow of cereal, milk, and wetted cereal, along sidewalls 308 without the wetted cereal sticking to the sidewalls. After cover 318 is removed to uncover opening 306 of lower container 304, and upper container 302 is re-attached to lower container 304, package 300 contains milk in lower container 304 and dry cereal in upper container 302, with the milk and dry cereal being separated by valve 320, which has openings that allow milk to flow between the two containers but that do not allow cereal pieces to pass from upper container 302 into lower container 304. To dispense a mixture of cereal and milk, a user tips package 300 to cause milk to flow from lower container 304, through upper container 302 and out of opening 311, which also causes cereal to flow from upper container 302 out of opening 311; the mixture of cereal and milk can be dispensed from opening 311, e.g., directly to a user's mouth.

Figure 8C:
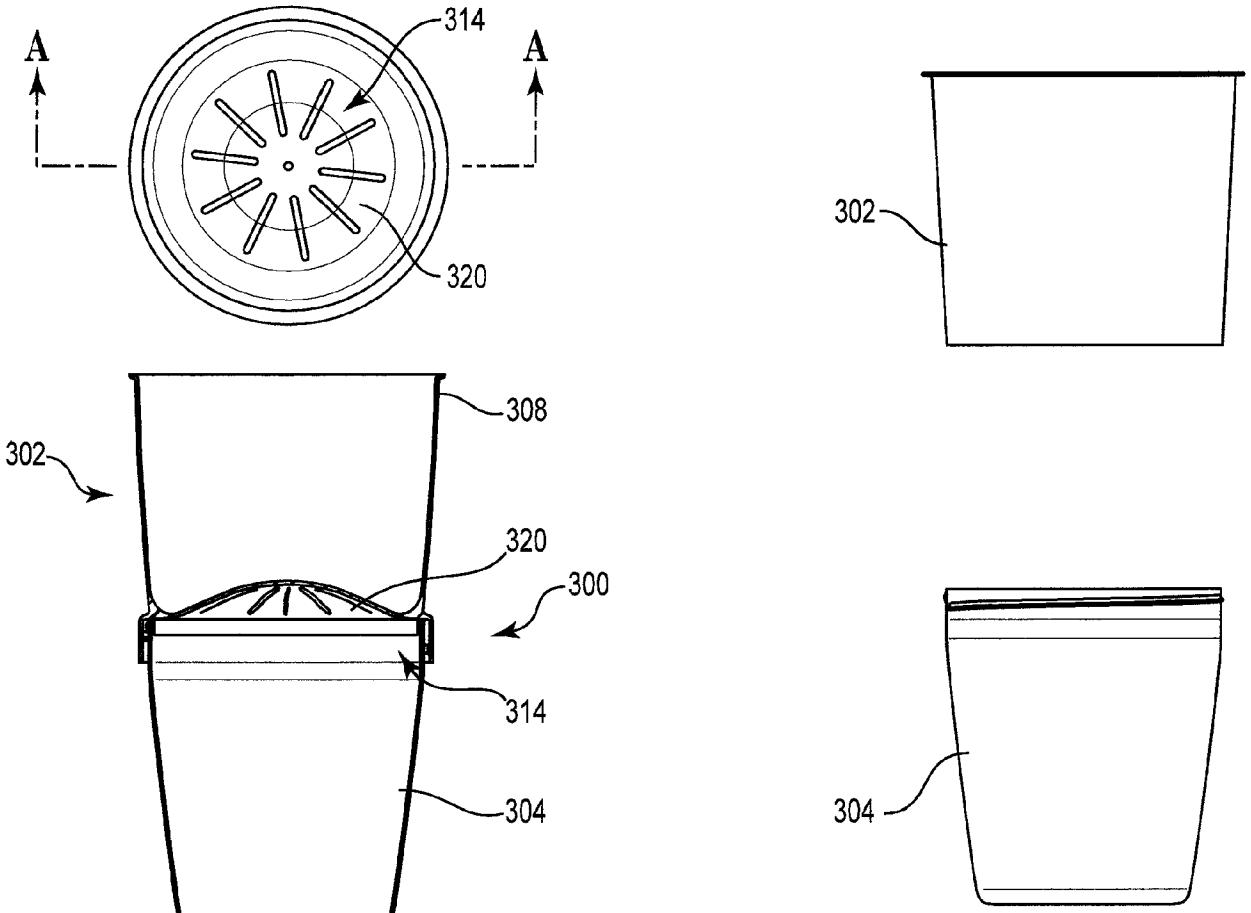
FIG. 8C includes top, side, and side cut-away views of a package as described.

See also FIGS. 8B and 8C.

"Cereal Ball"

Figure 9:
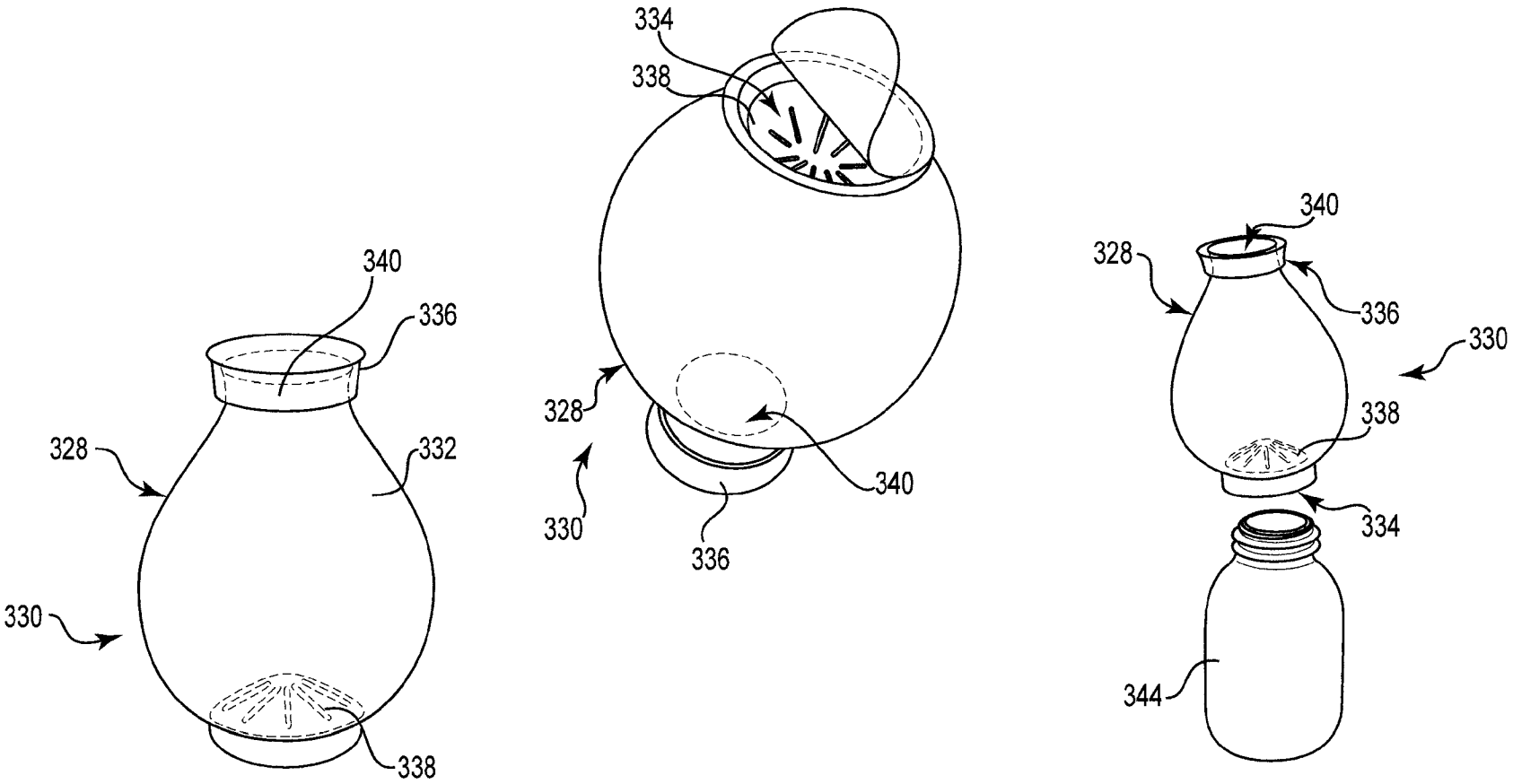
FIG. 9 illustrates various views of a package as described.

FIG. 9 illustrates a concept that involves the manufacture, marketing, packaging, and sale, of a cereal packaged without milk, but with the package being adapted to accept a milk chug that could be purchased separately or in combination with the cereal package. As shown at FIG. 9, the "cereal ball" package includes an upper container of a milk and cereal package that would be similar to package 300, including upper and lower openings and a valve at the lower opening that allows flow of a liquid (milk) through the valve in either direction but does not allow cereal pieces to pass. In use, a cover can be removed from the lower opening of the package and the lower opening can be engaged with a milk chug of a standardized size (e.g., diameter) and threading. A top cover can be removed from the upper opening of the package and a mixture of milk and cereal can be delivered from the upper opening by tipping the package. Milk flows from the lower container, through the upper container and is delivered to a user's mouth in combination with cereal from the upper container. Milk that does not reach the upper opening will flow back through the valve into the lower container.

Referring to FIG. 9, cereal package 330 includes cereal container 332 for containing dry cereal for storage, marketing, transport, and sale to a consumer. Package 330 includes upper opening 340, sidewalls 328, bottom opening 334, and cover 336 that covers upper opening 340. Cover 336 is secured to cereal container 332 around a rim at upper opening 340 by threads, and can be threaded and unthreaded (removed and replaced). Valve 338 is located within bottom opening 334 of container 332, and allows liquids (e.g., milk) to pass through in either direction, but does not allow cereal pieces to pass.

A lower container, 344, can be attached to bottom opening 334, e.g., by threads. Lower container 304 can contain milk, which can be refrigerated or shelf stable, for storage, marketing, transport, and sale to a consumer. When attached, opening 346 of lower container 344 engages bottom opening 334 in a sealing engagement. Container 332 is shaped to have convex sidewalls (328) to facilitate flow of cereal, milk, and wetted cereal, along sidewalls 328 without the wetted cereal sticking to the sidewalls. After cover 336 is removed to uncover opening 340 of container 330, lower container 344 contains milk, and container 332 contains dry cereal, the milk and cereal being separated by valve 338, which has openings that allow milk to flow between the two containers but that do not allow cereal pieces to pass from container 332 into container 344. To dispense a mixture of cereal and milk, a user tips the connected containers to cause milk to flow from container 344, through container 332 and out of opening 340, which also causes cereal to flow from container 332 out of opening 340; the mixture of cereal and milk can be dispensed from opening 340, e.g., directly to a user's mouth.

The cereal and milk packages described herein also include embodiments that can be stored or sold to include a single serving of cereal to be consumed with a single serving of milk, that can be portable and that can be used for eating cereal and milk using a traditional method of eating the cereal and milk using a spoon. In general, these embodiments of combined cereal and milk packages involve two containers, one for milk and one for cereal. The two containers may optionally be attached to each other and one or the other may optionally, additionally, include a spoon, napkin, or both, for use in consuming the milk and cereal. The two packages can be sized and shaped for convenient shipping together and can include features that facilitate use by eating using a spoon. An advantage of these types of combined cereal and milk package is easy transport of a serving of cereal and milk, to allow the user to take a serving from their home or to purchase the serving from a vendor, vending machine, convenience store, fast food outlet, restaurant, etc., to eat the cereal and milk in a location other than a conventional breakfast eating location, e.g., at an office or other location outside of a home or kitchen.

Figure 10:
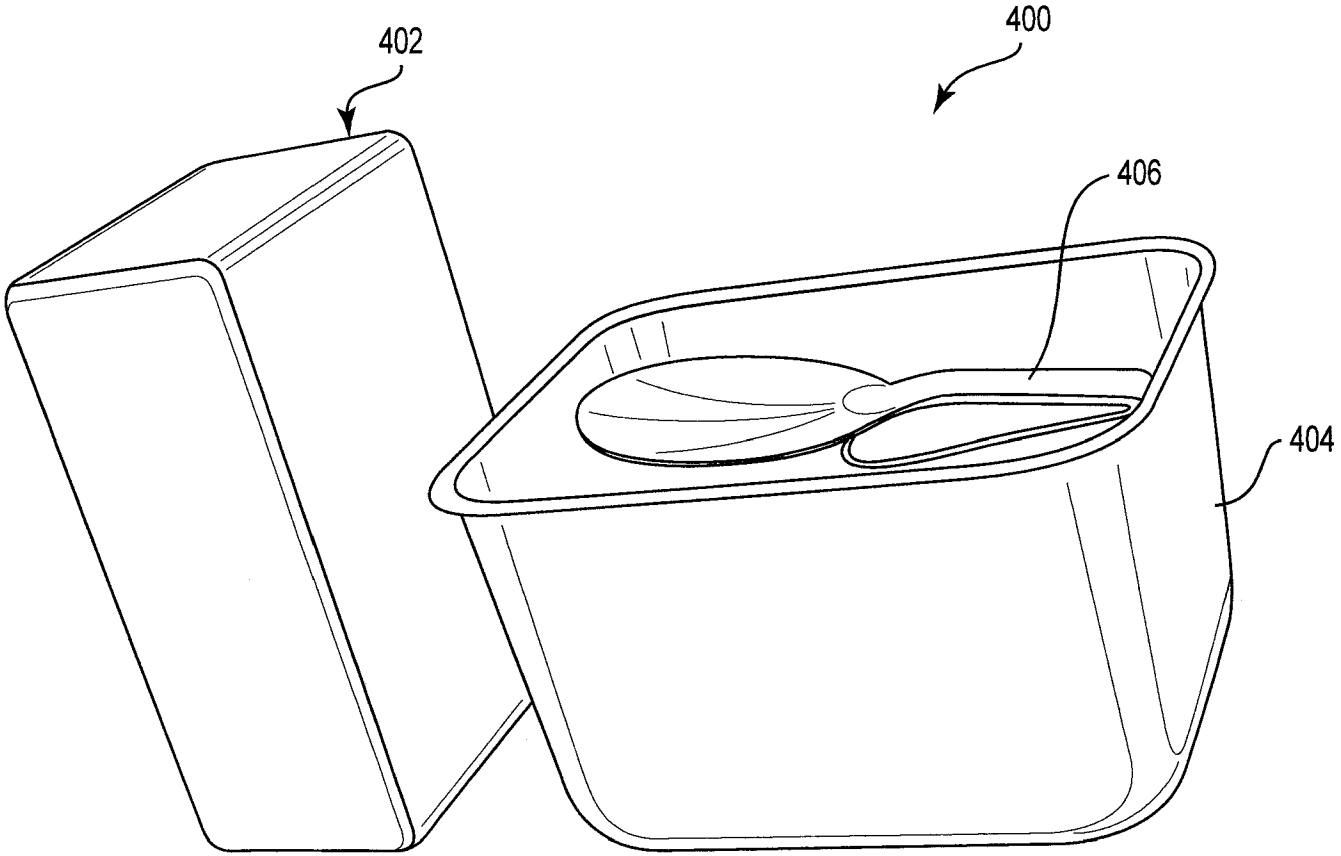
FIG. 10 illustrates a side perspective view of packages as described.

Referring to FIG. 10, combined milk and cereal package kit 400 includes milk package 402, containing milk; cereal package 404, containing dry cereal; a cover (not shown) for cereal package 404; and optional spoon 406 (shown as a foldable spoon). Milk package 402 and cereal package 404 are detached but could be attached in some form or contained together in a larger package. Spoon 406 is shown to be packaged inside of cereal package 404, but could also be within a larger package that contains milk package 402 along with cereal package 404. Milk package 402 can be a cardboard or plastic box or carton sealed for stable refrigerated or shelf-stable (ambient temperature) storage. Cereal package 404 can be a cardboard or plastic container that includes a bottom, sides, and an open top that can be covered (not shown) for storage and shipment. During use, the cover can be removed from cereal package 404, and the milk package 402 can be opened. Spoon 406 can be removed and milk from milk package 404 can be poured over the cereal in cereal package 402. The cereal and milk can be eaten using the spoon.

Figure 11:
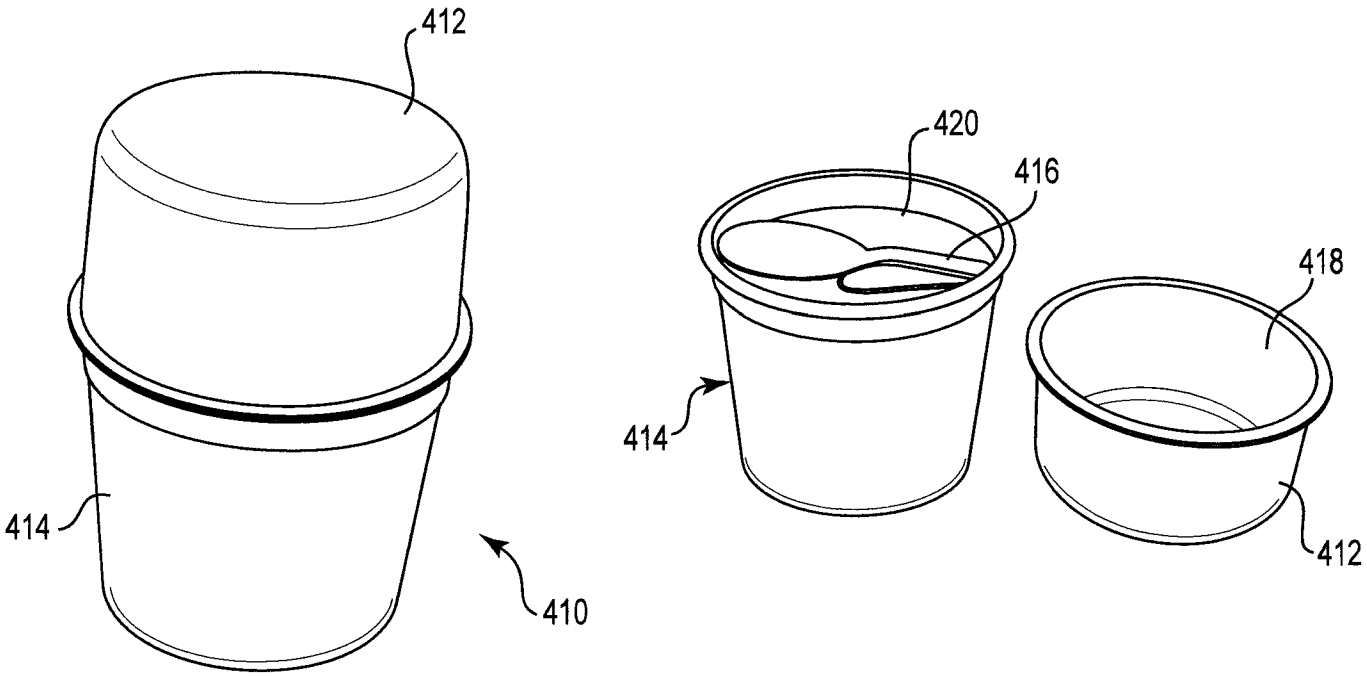
FIG. 11 illustrates a side perspective view of packages as described.

FIG. 11 illustrates another embodiment of portable cereal and milk package that can be used for eating cereal and milk conventionally, using a spoon. Combined milk and cereal package kit 410 includes upper container 412, containing milk; lower container 414, containing dry cereal (and optional spoon 416, illustrated to be foldable). Upper container 412 also functions as a cover for lower package 414. Upper container 412 and lower container 414 are configured to be attachable by upper container 412 being placed securely on top of lower container 414. Upper container 412 can on rest on a flange or widened rim of lower container 414 so that upper container 412 is supported and secured. Alternate modes of securing upper container 412 above lower container 414 may include a snap-fit mechanism, a threaded engagement between opposing surfaces of the two containers, adhesive, paper or plastic tape, or shrink wrapping at a seam between the two packages. Milk can be contained in upper container 412 by placing the milk directly in upper container 412 and placing a seal (e.g., foil or plastic) over opening 418.

Alternately, a container of milk such as a pouch, bag, or carton, can be placed in the upper container. The upper container can then be placed above and secured to lower container 414 to cover opening 420.

During use, upper container 412 can be removed from lower container 414, which exposes opening 420 to allow access to cereal (and optional spoon 416) within lower container 414. Upper container 412 (or a milk pouch, bag, or carton therein) can be opened, and milk can be emptied into lower package 414 to mix with cereal contained in lower package 414. Spoon 416 can be used to eat the mixture of milk and cereal from lower package 414.

Figure 12:
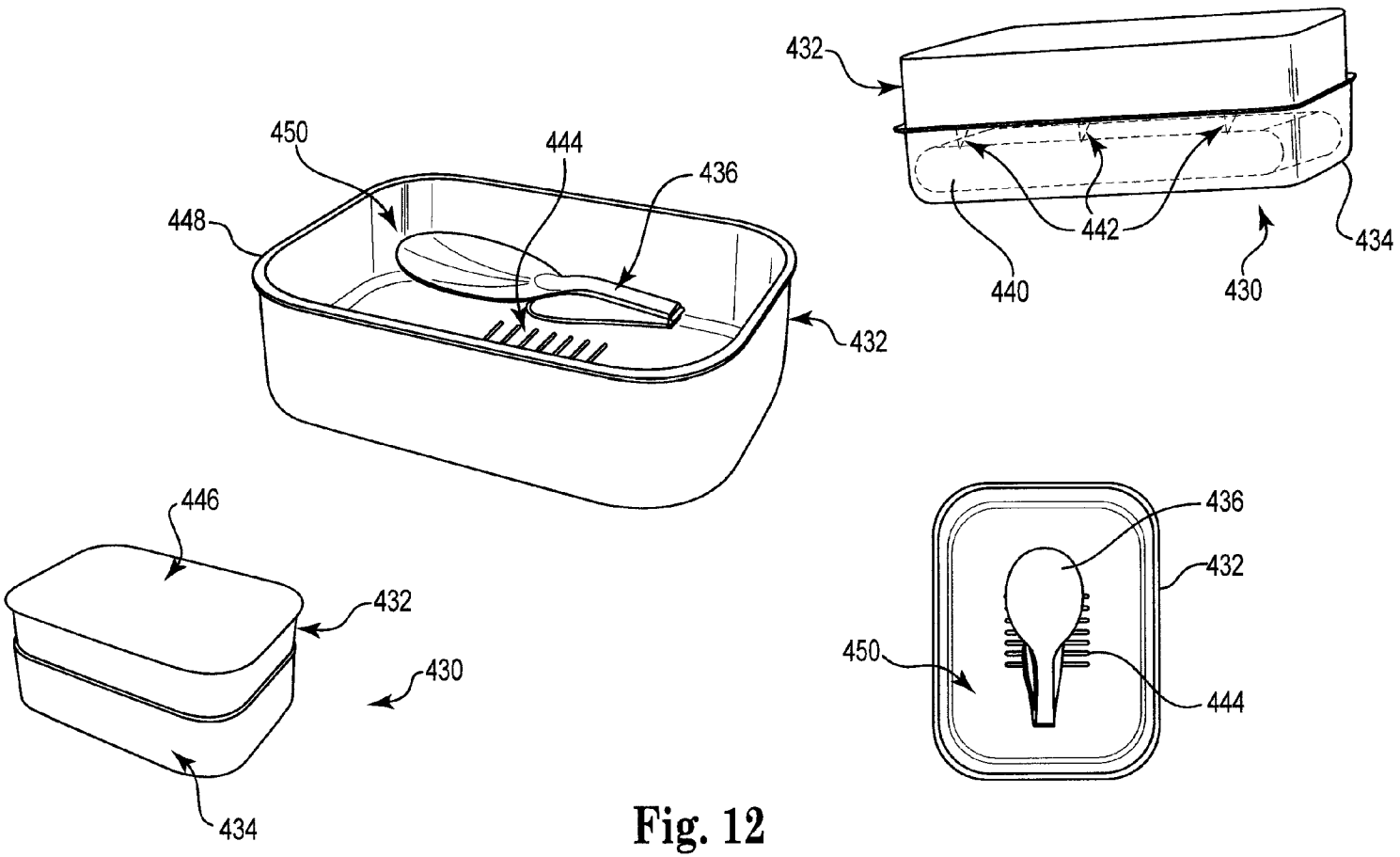
FIG. 12 illustrates a side perspective view of packages as described.

FIG. 12 illustrates another embodiment of portable cereal and milk package that can be used for eating cereal and milk conventionally, using a spoon. Combined milk and cereal package kit 430 includes upper container 432, containing dry cereal (and optional spoon 436 and an optional napkin, not shown). Upper container 432 and lower container 434 are nested or otherwise configured to be slidably engaged, or fitted one into the other. Upper container 432 can be covered by a cover 446, which may be paper or plastic that engages and seals upper opening 450 of upper container 432, and engages rim or flange 448, e.g., by an adhesive seal. Upper container 432 also includes vents or holes 444 that allow milk to flow from lower container 434 into upper container 432.

As illustrated, upper container 432 is initially situated above an opening of lower container 434, and upper container 432 has a size and shape that allow upper container 432 to fit within a space defined by sidewalls and a bottom of lower container 434. Lower container 434 includes milk package 440 that is breakable by pressure exerted onto milk package 440 by a bottom surface or a bottom surface structure of upper container 432, such as by projections (or "spikes") 442. For example, in an expanded configuration upper container 432 sits on top of milk package 440. A user may place pressure on upper container 432 in a direction toward milk package 440, e.g., a downward pressure. Projections or spikes (optionally having a sharpened or pointed structure) will cause milk package 440 to open, e.g., be punctured, and milk will be dispensed from milk package 440 into lower package 434. The milk will flow through holes 444 in upper container 432 as upper container 432 slides in a downward direction into the interior space of lower package 434, as milk empties from milk package 440 and milk package 440 empties or deflates. Afterward, a user can eat milk and cereal from collapsed package 430 using spoon 436, through opening 450.

Figure 13:
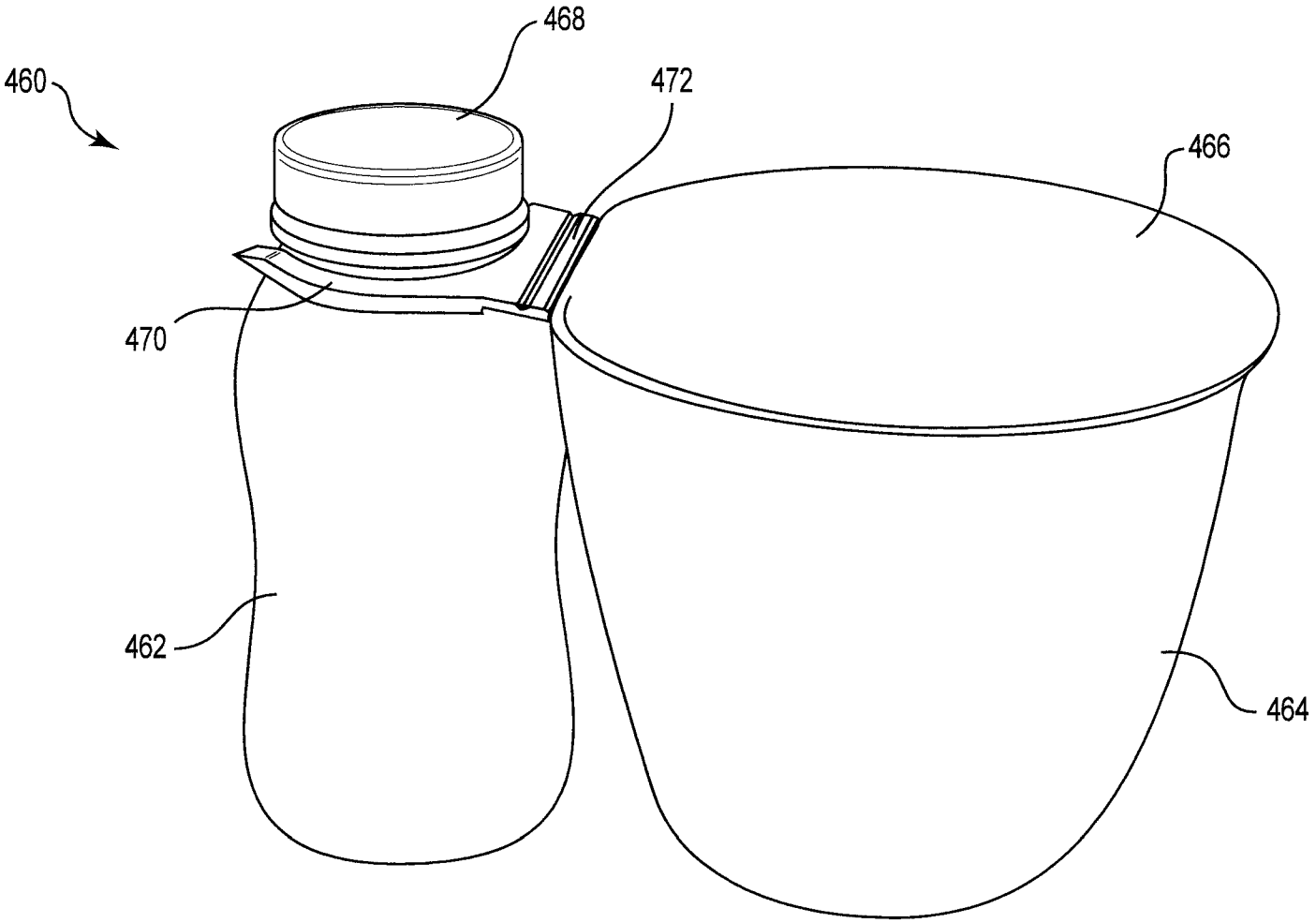
FIG. 13 illustrates a side perspective view of packages as described.

FIG. 13 illustrates another embodiment of portable cereal and milk package that can be used for eating cereal and milk conventionally, using a spoon. Combined milk and cereal package kit 460 includes milk container 462, containing milk, and cereal container 464, containing dry cereal (and an optional spoon, optional napkin, or both, not shown). Milk container 462 and lower container 464 are situated in a side-by-side configuration and connected together by bracket 470, which engages milk container 462, and which is also connected to cereal container 464 at hinge 472. Milk container 462 is closed and sealed by cover 468 which can be any type of sealing cover, such as a threaded cover. Cereal container 464 is covered and sealed by cover 466, which can be any cover, such as a plastic, paper, cardboard, or foil film secured to a perimeter of cereal container 464 by, e.g., adhesive.

During use, cover 468 can be removed to open milk container 462, and cover 466 can be removed to open cereal container 464. Milk container 462 can be pivoted about hinge 472 to allow milk to be poured from milk container 462 into cereal container 464. A mixture of milk and cereal can be eaten from cereal container 464.

Any of the above package configurations can be used with any type of particulate food as a dry cereal. Dry cereals are well known and examples of useful cereals include any breakfast (a.k.a. "ready-to-eat" cereals) available as particulates, flakes, etc., produced from known food ingredients such as wheat grain, corn, rice, oats, barley, triticale, and the like, optionally including additional ingredients such as salt, minerals, protein, sugar fiber (e.g., bran, cellulose, pectin), vitamins, flavorants, colorants, etc.

The milk may be of the type generally stored at refrigerated temperatures, or at ambient (e.g., "shelf stable," "extended shelf life" or "ultra-pasteurized" milk) conditions.

The amounts of each of the cereal and milk contained in a combined cereal and milk package can be any amount, and in particular can be an amount suitable for a single serving for one individual, e.g., about ¾ cup (or about 6 ounces) of cereal and abut 8 ounces of milk.

The materials of the package and containers thereof can be any packaging material currently available or designed in the future, including, for example, glass, paper, cardboard, and polymeric materials known for use in these applications. A glass or polymeric material may be see-through (transparent, clear, colored, shaded), opaque, translucent, colored, etc. Materials may be thermoplastic or thermoformed, or may be coated paper or cardboard, or combinations of these in multiple layers. In preferred embodiments an internal sidewall surface can be made of or coated to exhibit a of a low surface energy, e.g., a surface energy below about 50 dynes per centimeter, or less than 40 or 38 dynes per centimeter. Exemplary low surface area materials include polystyrene, polyvinylalcohol (PVA) polyethylene, polypropylene, and the like.

Following are exemplary embodiments that are not intended to limit the foregoing description.

In one embodiment, a combined cereal and milk package includes a milk container that contains milk and a cereal container that contains dry cereal, including one or more of the following features:

- The milk container can be vented so that pressure within the container equalizes when milk is delivered,
- Upon tipping the package, milk and cereal can flow separately into a cereal holding stage near an opening at the top of the package, where the milk contacts the cereal and the milk and cereal can be delivered through the opening to a consumer,
- The milk container can be located in a position below the cereal container and a cereal container can contain a milk channel that leads milk from the milk container to the cereal holding stage,
- A cereal holding stage can include an upper end of the milk tunnel in the form of a milk port that is of a size to regulate the flow of milk from the milk tunnel into the cereal holding stage.

In another embodiment a combined milk and cereal container includes a milk container and a cereal container:

- The milk container can be on a bottom portion of the package and attached directly to the cereal container, located above the milk container,
- The top of the milk container may engage the bottom of the cereal container by any secure mechanical engagement, such as by a threaded engagement or a snap-fit engagement,
- An opening of the milk container that engages the cereal container can have a seal,
- An opening of the cereal container that engages the milk container can have a cover that can be broken or dissolved (and that is edible), After unsealing the milk container, the cereal container can be re-attached to the milk container and shaken to open the cereal container and allow the cereal to be dispensed into the milk container, The cereal container may be removed and milk and cereal can be delivered to a consumer directly from the milk container.

In another embodiment a combined milk and cereal container includes a milk container and a cereal container:

The milk container can be on a bottom portion of the package and attached directly to the cereal container, located above the milk container, The top of the milk container may engage the bottom of the cereal container by any secure mechanical engagement, such as by a threaded engagement or a snap-fit engagement, An opening of the milk container that engages the cereal container can have a seal, An opening of the cereal container that engages the milk container can have a cover that can be broken or dissolved (and that is edible), The cereal container can include a second ("upper") opening through which a mixture of cereal and milk can be dispensed after milk and cereal are combined within the package, After unsealing the milk container, the cereal container can be re-attached to the milk container and shaken to break or dissolve the cereal container cover and open the cereal container, allowing cereal to transfer from the cereal container to the milk container, Milk and cereal can be delivered to a consumer from the upper opening at the top of the cereal container while the cereal container is engaged with the milk container.

In another embodiment a combined milk and cereal container includes a milk container and a cereal container:

The milk container can be on a bottom portion of the package and attached directly to the cereal container, located above the milk container, The top of the milk container may engage the bottom of the cereal container by any secure mechanical engagement, such as by a snap-fit engagement or a threaded engagement, e.g., a standardized threaded engagement, An opening of the milk container that engages the cereal container can have a seal, The cereal container can include a second ("upper") opening through which a mixture of cereal and milk can be dispensed after milk and cereal are combined within the package, e.g., in the cereal container, An opening between the cereal container and the milk container can includes a "screen" (or "filter") that allows milk to flow from the milk container into the cereal container, or from the cereal container into the milk container, but does not allow cereal to pass from the cereal container to the milk container, After unsealing the milk container, the cereal container can be re-attached to the milk container, Milk and cereal can be delivered to a consumer from the upper opening at the top of the cereal container while the cereal container is engaged with the milk container, The cereal and milk containers may be packaged or sold together in combination, e.g., as a kit, or separately.

In another embodiment, a kit that includes separate milk and cereal containers can include:

A milk container comprising a plastic, paper, or cardboard carton or box,

A cereal container containing cereal, optionally an eating implement such as a spoon, and optionally a napkin, The cereal container can be sealed by a paper, cardboard, or foil layer that is secured to an opening on the cereal container and that can be peeled away to open the cereal container, Milk can be poured into the cereal container and consumed using the spoon.

In another embodiment, a kit that includes separate milk and cereal containers can include:

A milk container comprising a plastic, paper, or cardboard carton or box,

A cereal container containing cereal, optionally an eating implement such as a spoon, and optionally a napkin, A bottom of the milk container fit and engage the top of the cereal container to allow a "stacked" configuration, The cereal container can be sealed by a paper, cardboard, or foil layer that is secured to an opening on the cereal container and that can be peeled away to open the cereal container, After removing the milk container from above the cereal container and opening the milk container, milk can be poured into the cereal container and consumed using the spoon.

In another embodiment, a combined milk and cereal package that includes separate milk and cereal containers can include:

A milk container that contains milk and includes a dish and a breakable membrane, pouch, or bag, that contains the milk, A cereal container containing cereal, optionally an eating implement such as a spoon, and optionally a napkin, the cereal container also include holes at a bottom through which milk can flow, The cereal container being located above the milk container, e.g., in a nested configuration, and having a structure at a bottom surface that can open the milk container, A top opening of the milk container engages the cereal container and allows the cereal container to fit within the milk container, The cereal container can be sealed by a paper, cardboard, or foil layer that is secured to an opening on the cereal container and that can be peeled away to open the cereal container, After opening the cereal container, pressure can be applied to the cereal container to cause the bottom of the cereal container to contact the breakable membrane, pouch, or bag, The cereal container can be lowered into the milk container dish and milk flows through the holes in the cereal container to mix with the cereal, The cereal and milk can be eaten from the cereal container using the spoon.

In another embodiment, a kit that includes separate milk and cereal containers can include:

A milk container in the form of a plastic bottle,

A cereal container containing cereal, optionally an eating implement such as a spoon, and optionally a napkin, A bracket and hinge that engage the milk container and the cereal container so that the milk container can be opened and the cereal container can be opened, and the milk bottle can be pivoted at the hinge to pour milk into the cereal container, Milk and cereal can then be eaten from the cereal container.

The invention claimed is:

1. A multi-container package comprising a lower container comprising a lower container interior space defined by:

a bottom;

sidewalls extending upwardly from the bottom, wherein the sidewalls have an upper edge; and an upper opening extending between the upper edges of the sidewalls;

an upper container connected to the lower container, the upper container comprising:

an upper container interior space defined by sidewalls having an upper edge and a lower edge; and an upper container bottom extending between the upper container sidewalls at the lower edge of the upper container sidewalls, wherein the entire upper container bottom is positioned above the upper opening of the lower container;

a passage in fluid communication with the lower container interior space and the upper container interior space that allows liquid to flow out of the lower container interior space and into the upper container interior space as the package is tipped forward toward a front side of the package, wherein the passage comprises a lower edge at the upper container bottom and an inner passage wall that extends upwardly from the upper container bottom and that extends from a portion of the upper container sidewalls into the upper container interior space; and a vent spaced from the passage and located within the upper container interior space, wherein the vent allows pressure to equalize in the lower container interior space as the package is tipped forward and liquid flows out of the lower container interior space, wherein the vent comprises an upper vent opening located within the upper container interior space and spaced from the bottom of the upper container interior space, a lower vent opening at the upper container bottom, and a channel extending between the upper and lower vent openings, and wherein the upper container interior space does not extend into the lower container interior space.

2. A package according to claim 1 wherein the passage comprises an aperture located at the bottom of the upper container interior space.

3. A package according to claim 1 wherein the passage comprises a valve at the bottom of the upper container.

4. A package according to claim 1 wherein the upper container comprises a holding stage at an upper region of the upper container defined by a shelf and sidewalls, and the passage comprises a channel.

5. A package according to claim 4 wherein the channel connects the lower container interior space and the holding stage.

6. A package according to claim 1 comprising multiple pieces including a lower container piece comprising the lower container interior space and an upper container piece comprising the upper container interior space.

7. A package according to claim 5 comprising multiple pieces wherein the lower container piece bottom extends between the lower container piece sidewalls at a lower region of the sidewalls, wherein:

the lower container piece further comprises a lower container upper-container engagement at an upper region of the lower container; and the upper container piece further comprises an upper container lower-container-engagement that engages the lower container upper-container engagement in a liquid-tight manner.

8. A package according to claim 7 wherein the upper container piece comprises an extension sidewall extending from a perimeter of the upper container toward the lower container, the extension sidewall comprising the upper container lower-container-engagement that engages the lower container upper-container engagement in a liquid-tight manner.

9. A package according to claim 1 wherein the bottom of the upper container interior space comprises an aperture at a front and an aperture at a back.

10. A method of dispensing milk and cereal, comprising providing a package according to claim 1 wherein the upper container contains cereal and the lower container contains milk, and tipping the package to cause milk and cereal to dispense from the package.

* * * * *